US007177581B2

(12) United States Patent
Kawada et al.

(10) Patent No.: US 7,177,581 B2
(45) Date of Patent: Feb. 13, 2007

(54) IMAGE FORMING APPARATUS

(75) Inventors: Masaya Kawada, Mishima (JP); Hiroaki Kawakami, Yokohama (JP); Noriyoshi Umeda, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 10/995,301

(22) Filed: Nov. 24, 2004

(65) Prior Publication Data

US 2005/0117944 A1 Jun. 2, 2005

(30) Foreign Application Priority Data

Nov. 28, 2003 (JP) ..... 2003-398684

(51) Int. Cl.
*G03G 21/00* (2006.01)
*G03G 15/00* (2006.01)

(52) U.S. Cl. ..... 399/349; 399/159

(58) Field of Classification Search ..... 399/94, 399/96, 159, 349, 350, 353, 357; 430/56, 430/66

See application file for complete search history.

(56) References Cited

U.S. PATENT DOCUMENTS

| | | | | |
|---|---|---|---|---|
| 4,985,330 | A | 1/1991 | Tsuchiya et al. | 430/130 |
| 5,114,814 | A * | 5/1992 | Sakoh et al. | 430/46 |
| 5,300,987 | A * | 4/1994 | Aoyama et al. | 399/96 |
| 5,411,827 | A | 5/1995 | Tamura et al. | 430/58 |
| 5,427,880 | A | 6/1995 | Tamura et al. | 430/59 |
| 5,496,671 | A | 3/1996 | Tamura et al. | 430/58 |
| 6,197,463 | B1 * | 3/2001 | Cais et al. | 430/56 X |
| 6,272,301 | B1 | 8/2001 | Kawada et al. | 399/148 |
| 6,442,367 | B1 | 8/2002 | Itami et al. | 399/349 |
| 6,564,711 | B1 * | 5/2003 | Meyer | 399/349 X |
| 6,640,080 | B2 * | 10/2003 | Endo et al. | 399/349 |
| 6,728,508 | B2 * | 4/2004 | Kabashima et al. | 399/349 |
| 2005/0019684 | A1 * | 1/2005 | Sekiya et al. | 430/66 |
| 2005/0196196 | A1 * | 9/2005 | Ota et al. | 399/159 |
| 2005/0244737 | A1 * | 11/2005 | Baba et al. | 399/159 X |
| 2005/0254856 | A1 * | 11/2005 | Miura et al. | 399/159 |

FOREIGN PATENT DOCUMENTS

| | | |
|---|---|---|
| JP | 2-127652 | 5/1990 |
| JP | 5-216249 | 8/1993 |
| JP | 7-72640 | 3/1995 |
| JP | 2001-51576 | 2/2001 |
| JP | 2001-166509 | 6/2001 |
| JP | 2001-166517 | 6/2001 |

(Continued)

*Primary Examiner*—Sandra L. Brase
(74) *Attorney, Agent, or Firm*—Fitzpatrick, Cella, Harper & Scinto

(57) ABSTRACT

An image forming apparatus provided with a photosensitive member, a charging device for charging the photosensitive member, a developing device for developing an electrostatic image formed on the photosensitive member by a developer, a cleaning blade for removing the developer residual on the photosensitive member, a rubbing member provided upstream of the cleaning blade in the direction of rotation of the photosensitive member for rubbing the photosensitive member to assist the cleaning blade in cleaning, and a controller for controlling the surface temperature of the photosensitive member, wherein the photosensitive member has the HU (universal hardness value) of 150 N/mm$^2$ or greater and 220 N/mm$^2$ or less, and the elastic deformation rate of 43% or greater and 65% or less.

4 Claims, 6 Drawing Sheets

FOREIGN PATENT DOCUMENTS

| | | |
|---|---|---|
| JP | 2001-166520 | 6/2001 |
| JP | 2001-175016 | 6/2001 |
| JP | 2001-265044 | 9/2001 |
| JP | 2002-40686 | 2/2002 |
| JP | 2002-182536 | 6/2002 |
| JP | 2002-236382 | 8/2002 |

* cited by examiner

IMAGE FORMING APPARATUS

BACKGROUND OF THE INVENTION

1. Field of the Invention

The invention relates to an image forming apparatus of the electrophotographic type, and specifically to an image forming apparatus having cleaning means for cleaning an electrophotographic photosensitive member.

2. Description of Related Art

[Background of the Electrophotographic Apparatus]

In recent years, an organic photoconductor (hereinafter referred to as the OPC) having an organic photoconductive material has been widely utilized as the electrophotographic photosensitive member (hereinafter simply referred to as the photosensitive member) of an image forming apparatus of the electrophotographic type. The OPC has such advantages as the case with which a material coping with various exposure wavelengths is developed, and a low cost of manufacture, but is weak in mechanical strength and the surface of the photosensitive member is liable to be deteriorated during a great deal of print, and in some cases, there has arisen the problem that the surface of the photosensitive member is liable to be injured.

Particularly recently, as the needs of the market, importance has been attached to such characteristics as long life and maintenance freedom, in addition to coloring and a higher quality of image.

Specifically, importance has been attached to such characteristics as the stabilization of a latent image and visualized image characteristic, and an anti-wear property, and more importance has come to be attached to the durability against the chemical deterioration, mechanical deterioration and electrical deterioration of the photosensitive member and a system.

In an electrophotographic image forming apparatus using the usually used Carlson method, the photosensitive member is repetitively subjected to the charging, exposing, developing, transferring and cleaning steps and therefore, there is the high possibility of the wear of the photosensitive member and the adherence of foreign substances thereto being caused by electrical and mechanical extraneous forces.

From such a background, the electrophotographic photosensitive member is required to have durability against chemical, electrical and mechanical extraneous forces such as the chemical deterioration by ozone and nitrogen oxides during charging, and the mechanical deterioration and electrical deterioration by discharge during charging and the rub of a cleaning member.

Various studies have been made in order to satisfy the various characteristics required as noted above.

For example, in order to improve the durability of the above-described OPC, there has been studied the technique of improving the anti-discharge stability of the OPC and the durability thereof against mechanical deterioration and electrical deterioration.

As an approach to it, in the above-described OPC, there has been reported a method of using hardenable resin as resin for a charge transporting layer (for example, Japanese Patent Application Laid-open No. H02-127652).

Also, there has been reported an OPC using hardenable resin containing a charge transporting material, and further provided with a lubricant and an oxidation preventing function (for example, Japanese Patent Application Laid-open No. 2001-175016, Japanese Patent Application Laid-open No. 2002-040686, Japanese Patent Application Laid-open No. 2001-166520, Japanese Patent Application Laid-open No. 2002-236382 and Japanese Patent Application Laid-open No. 2001-265044).

However, an increase in the mechanical strength of the OPC and a reduction in the abrasion speed thereof have sometimes caused a case where it becomes difficult to remove adhering materials attributable to a toner, paper dust, etc. adhering to the surface of the photosensitive member which have heretofore been effectively removed by abrasion, and as a result, the lowering of the quality of image such as image deletion under a high humidity environment is caused by the accumulated adhering materials.

As improving means for such case, there have been reported a method of prescribing, in a system wherein there are disposed a photosensitive member having an outermost surface formed of resin having cross-linking structure, and cleaning means comprising a cleaning blade, and further having a brush roller for assisting in cleaning, the shape characteristic of the brush roller and such installation conditions to the photosensitive member as the push pressure with which the brush roller is pushed against the photosensitive member, and driving torque (for example, Japanese Patent Application Laid-open No. 2001-051576), and a method of prescribing the range of an expression comprising the shape characteristics of the brush roller such as the thickness of fiber and brush density, the Young's modulus of the brush, the installation conditions to the photosensitive member and the driving condition (for example, Japanese Patent Application Laid-open No. 2002-182536).

Japanese Patent Application Laid-open No. 2001-051576, however, discloses nothing regarding the result of image such as image deletion. Also, in Japanese Patent Application Laid-open No. 2002-182536, it is described that an abrasion speed less than 0.45 μm/200 kc (1 kc=1000 copies) is insufficient for the prevention of the deterioration of the photosensitive member.

Also, in the above-described methods, even under a condition in which the so-called ordinary image deletion can be suppressed and as a matter of course, cleanability is good, there has been a case where a streak-like image defect is caused by wear resistance (plate wear). Such a streak-like defect is halftone on the high light side and is easy to see. This is a problem particularly in a color image forming apparatus which outputs such an image, and is a greater problem in an apparatus aiming at a high quality of image.

About the streak-like image defect caused by the print resistance, we have compared and evaluated various photosensitive members differing in abrasion resistance from one another with a result that it has been found that such a defect is liable to occur to a photosensitive member which is small in abrasion speed, that is, high in abrasion resistance.

SUMMARY OF THE INVENTION

It is an object of the present invention to provide an image forming apparatus which can output good images for a long period.

It is another object of the present invention to provide an image forming apparatus which can keep a good cleaning property for a long period.

It is another object of the present invention to provide an image forming apparatus which improves the durability of a photosensitive member and a cleaning member.

It is another object of the present invention to provide an image forming apparatus which can prevent an image defect such as a streak-like defect due to wear resistance and on the other hand, can maintain the durability of a photosensitive member and cleaning means at a high level.

Further objects and features of the present invention will become apparent from the following detailed description when read with reference to the accompanying drawings.

DESCRIPTION OF THE PREFERRED EMBODIMENTS

Some preferred embodiments of the present invention will hereinafter be described in detail by way of example with reference to the drawings. However, the dimensions, materials, shapes, relative arrangement, etc. of constituent parts described in these embodiments, unless particularly described, are not intended to restrict the scope of this invention thereto. Also, the materials, shapes, etc. of members once described in the following description, unless particularly newly described, are similar to those described at first.

(Embodiments)

Image forming apparatuses according to the embodiments will hereinafter be described with reference to FIGS. 1 to 7.

[Epitome of the Main Body of an Image Forming Apparatus]

Figure 1:
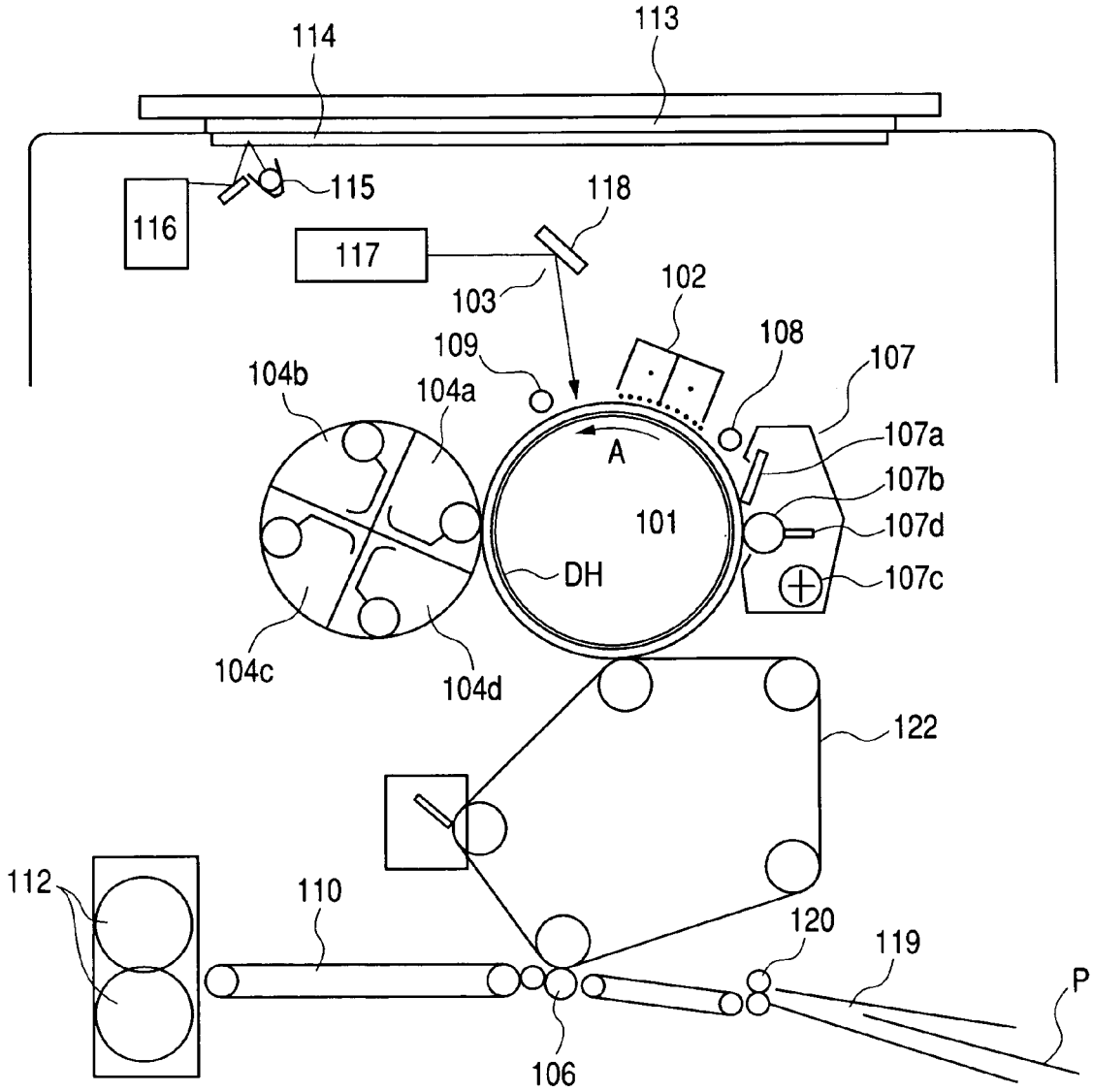
FIG. 1 is a typical cross-sectional view of an image forming apparatus according to an embodiment of the present invention.

Reference is first made to FIG. 1 to describe an image forming apparatus according to the present embodiment. FIG. 1 is a typical cross-sectional view of the image forming apparatus according to the present embodiment.

A photosensitive member 101 is supported for rotation about an axis perpendicular to the plane of the drawing sheet of FIG. 1, and has therein a drum heater DH as temperature controlling means for controlling the surface temperature of the photosensitive member. Charging means 102, exposing means 103, developing means 104, transferring means 122, cleaning means 107, charge eliminating means 108, an internal potential sensor 109, etc. are provided at respective suitable angular positions around the photosensitive member 101.

The exposing means 103 is comprised of an image signal source 117 and a mirror 118 for reflecting light such as a laser beam emitted from the image signal source 117.

An image signal is obtained by reading and converting light resulting from light emitted from an image reading light source 115 having reflected an original 113 placed on an original stand 114 in conformity with the gradation of the original, by a scanner 116.

The photosensitive member 101 is uniformly charged by the charging means (e.g. a corona discharging device) 102, and a latent image conforming to the image signal is formed thereon by the exposing means 103. The latent image is developed as developer images by the developing means 104 (having four yellow, magenta, cyan and black developing devices 104*a* to 104*d* because the image forming apparatus of the present embodiment is a color image forming apparatus).

The developer images of the respective colors are successively transferred to the primary transferring means (e.g. an intermediate transfer belt) 122 and are superimposed one upon another, and thereafter are collectively transferred to a transfer material P conveyed on a sheet feeding route 119 and timed by registration rollers 120, by secondary transferring means (e.g. a transfer roller) 106.

Thereafter, the transfer material P is conveyed to fixing means 112 by a conveying belt 110, and the developer images are fixed on the transfer material P.

The cleaning means 107 for removing any residual on the photosensitive member has an elastic blade as a cleaning member 107*a*, and a rubbing member 107*b* contacting with and rotatable by the photosensitive member 101. This rubbing member 107*b* is provided with the function of assisting the cleaning member 107*a* in the cleaning of the photosensitive member. Also, it may be provided with waste toner carrying means 107*c*, a scraper 107*d*, etc. as required.

Figure 2A:
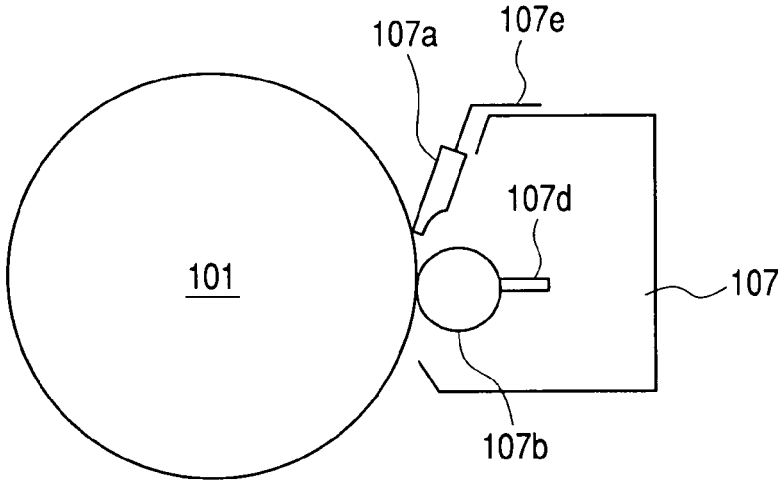
FIGS. 2A, 2B and 2C are typical cross-sectional views showing a method of fixing a cleaning member according to an embodiment of the present invention.
Figure 2B:
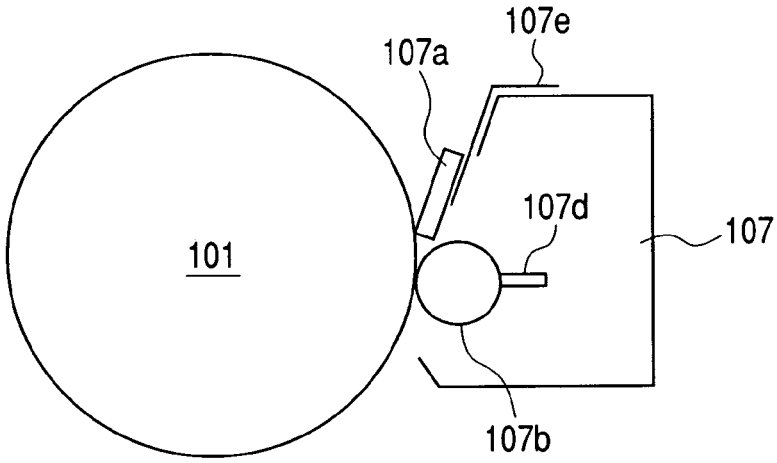
Figure 2C:
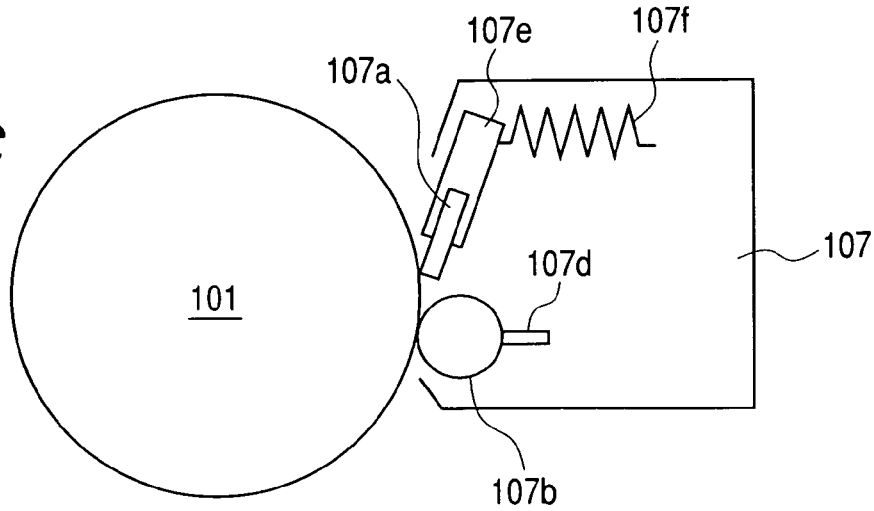

A well-known cleaning member can be used as the cleaning member 107*a*. Also, a well-known method can be used as a method of fixing it, and as shown in FIGS. 2A, 2B and 2C, use can be made of a so-called tip blade type (FIG. 2A) in which an elastic blade is fixed to the tip end of a supporting plate 107*e* which is supporting means, a so-called metal plate blade type (FIG. 2B) in which a plate-shaped elastic blade is fixed to a supporting plate 107*e*, or a so-called spring pressure type (FIG. 2C) in which a supporting plate 107*e* having an elastic blade fixed thereto is brought into contact with the photosensitive member by a spring 107*f* or the like.

Each element according to the present embodiment will hereinafter be described.

[Organic Photoconductor (OPC)]

<Layer Construction>

Figure 3:
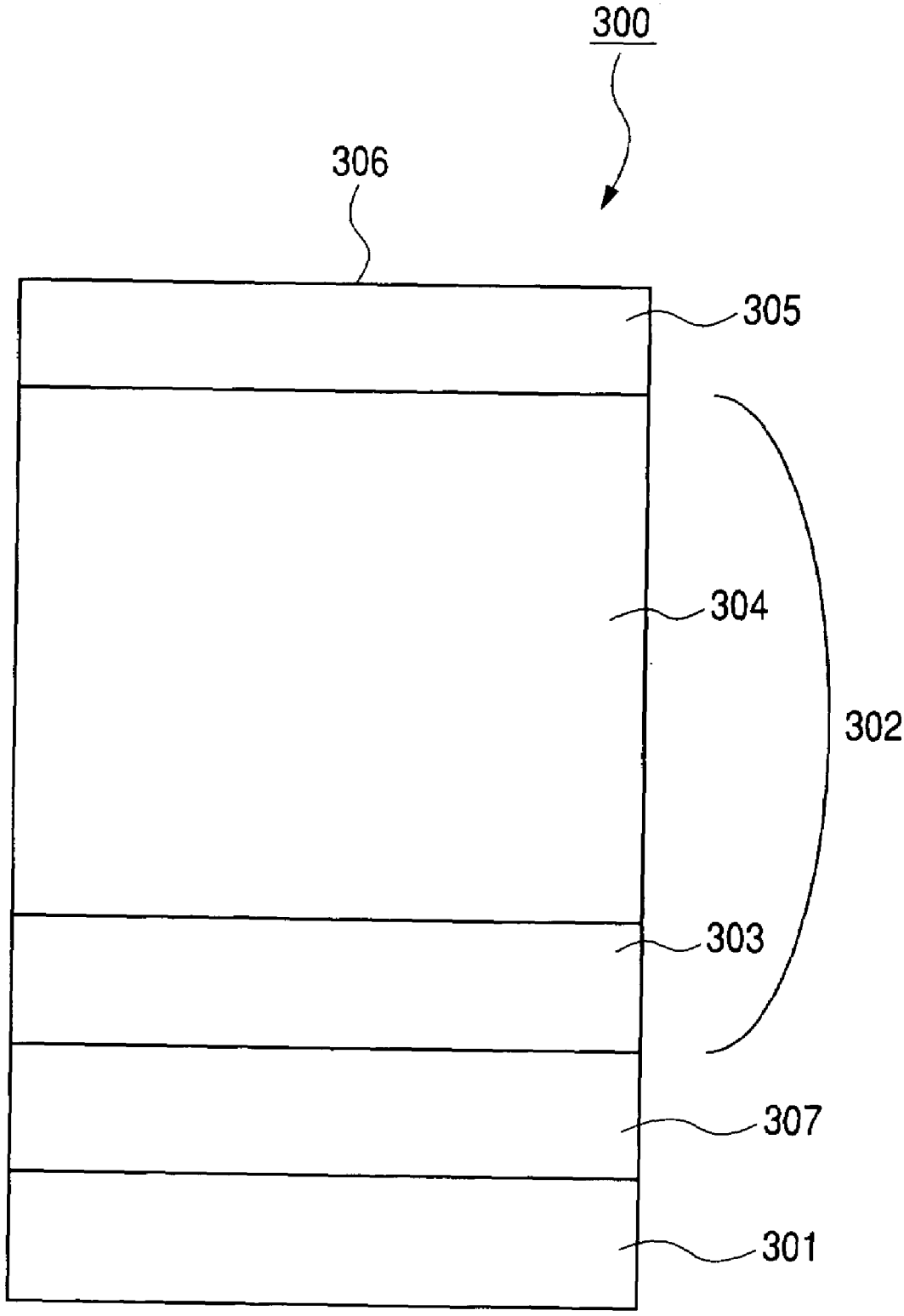
FIG. 3 is a typical view showing the layer construction of a photosensitive member suitably used in an image forming apparatus of the electrophotographic type according to an embodiment of the present invention.

FIG. 3 typically shows the layer construction of a photosensitive member suitably used in an image forming apparatus of the electrophotographic type according to an embodiment of the present invention.

The photosensitive member 300 according to the present embodiment has a photosensitive layer 302 and a surface layer (OCL) 305 successively laminated on an electrically conductive supporting member 301, and the outermost surface of the surface layer 305 is a free surface 306.

The photosensitive layer 302 is shown as a construction in which a charge generation layer 303 containing a charge generation material and a charge transport layer 304 containing a charge transport material are laminated in the named order, but alternatively can adopt a construction comprising single photosensitive layer 302 in which the charge generation material and the charge transport material are dispersed. In the former laminated type, a construction in which two or more charge transport layers 304 are provided is also possible. In any case, the photosensitive layer 302 can contain a charge transport compound.

However, from the viewpoint of the characteristic as the electrophotographic photosensitive member, particularly an electrical characteristic such as residual potential and durability, it is preferable in the construction of a function separated type photosensitive member in which the charge generation layer 303, the charge transport layer 304 and the surface layer 305 are laminated in the named order that a polymer of a charge transport compound having a chain polymerization group containing a charge transport compound be contained in at least the surface layer 305, whereby the higher durability of the surface layer becomes possible without the charge transporting capability being reduced.

Also, as shown in FIG. 3, an electrically conducting layer 307 comprising an electrically conducting layer or an undercoat layer or the like having a rectifying property may be added between the electrically conductive supporting member 301 and the photosensitive layer 302. The electrically conducting layer 307 may preferably set within a range of 10–20 μm.

<Surface Layer>

It is preferable from the viewpoint of securing high durability that the photosensitive member according to the present embodiment has a surface layer containing a cross-linking structure, and particularly having a charge transporting function.

Specifically, mention may be made of a photosensitive member formed with charge moving layer hardened film by a monomer having carbon-carbon dual coupling being contained in a charge moving layer, and being reacted to the carbon-carbon dual coupling of a charge moving material by the energy of heat or light (see, for example, Japanese Patent Application Laid-open No. H05-216249, Japanese Patent Application Laid-open No. H07-72640, etc.), or a photosensitive member having a surface layer by a siloxane compound being cross-linked (see, for example, Japanese Patent Application Laid-open No. 2002-182536).

Further, it is preferable that in order to improve a frictional characteristic, the surface layer be a surface layer containing a fluorine atom containing compound or the like as a lubricant, and as such a surface layer, a heat hardening type surface layer, an ultraviolet ray hardening type surface layer, an electron beam hardening type surface layer, etc. described in Japanese Patent Application Laid-open No. 2001-166509, Japanese Patent Application Laid-open No. 2001-166517, etc. are preferable.

[Method of Manufacturing the Photosensitive Member]

A method of manufacturing the electrophotographic photosensitive member according to the present embodiment will now be shown specifically.

A well-known photosensitive member can be used for a layer under (on the supporting member side) the surface layer. This will be described briefly.

The supporting member for the photosensitive member can be one having electrical conductivity. It is also preferable to control the surface shape of the supporting member by the close contacting property of film and the prevention of the interference of coherent light such as a laser beam.

An undercoat layer having a barrier function and an adhesive function can be provided on the electrically conductive supporting member.

The undercoat layer is formed for the improvement of the adhesive property of the photosensitive layer, the improvement of coating, the protection of the supporting member, the covering of a defect on the supporting member, the improvement of a charge injecting property from the supporting member, and the protection of the photosensitive layer against electrical destruction. The film thickness of the undercoat layer should preferably be 0.1–2 μm.

When the photosensitive member according to the present embodiment is a photosensitive member of a function separating type, a charge generation layer and a charge transport layer are laminated. A well-known material can be used as a charge generation material for use as the charge generation layer, and the film thickness thereof should preferably be 5 μm or less, and particularly preferably be within a range of 0.1–2 μm.

A well-known material can also be used as the material of the charge transport layer, and the film thickness of the charge transport layer should preferably be set so that the total thickness of the charge transport layer and the charge generation layer may be 5–50 μm, and particularly in a system having a surface layer excellent in abrasion resistance as in the present-embodiment, it is preferable from the viewpoints of cost, etc. that the charge transport layer be made into a thinner layer. The film thickness of this layer should preferably be 30 μm or less, and optionally be 20 μm or less.

The surface layer has abrasion resistance and weather resistance according to the present embodiment as well as a good frictional characteristic, and is one of important factors for maintaining a cleaning property well.

A preferred example of a surface layer material according to the present embodiment is hardenable resin having a chain polymerization functional group containing a charge transport compound. Also, a charge transport compound may be contained in the skeleton of the structure of the hardenable resin. In this case, it is not necessary to intentionally add such a charge transport material as will hamper hardenability, and the control of a film characteristic can be done easily.

The charge transport compound having the aforementioned chain polymerization functional group is first applied onto the aforedescribed photosensitive member as a solution containing the charge transport compound.

At that time, a lubricant should preferably be added as required. The lubricant can be added by the technique of dispersing the aforementioned fluorine containing resin in the surface layer material by the use of a suitable dispersing agent. In the present embodiment, the rate of the lubricant to be contained in the surface layer may preferably be 1–50% relative to the total weight of the layer which becomes the surface layer, and more preferably be 5–30%. If the lubricant is more than 50%, the mechanical strength of the layer which becomes the surface layer is liable to lower, and if the lubricant is less than 1%, the water-shedding quality and slip property of the layer which becomes the surface layer sometimes become insufficient.

It is popular to polymerization-react the above-mentioned solution after the application thereof, but a solution containing the charge transport compound may be reacted in advance to thereby obtain a hardened material, and thereafter it may be again dispersed or dissolved in a solution to thereby form the surface layer. As a method of applying these solutions, use may be made, for example, of a well-known coating method. For example, there are known the immersion coating method, the spray coating method, the curtain coating method and the spin coating method, but the immersion coating method is preferable from the viewpoints of efficiency and productivity. Also, other known film forming methods such as vapor deposition and plasma can be suitably selected.

The charge transport compound having the chain polymerization group according to the present embodiment can be polymerized by heat, light or radiation. Preferably it can be polymerized by radiation.

The greatest advantage of the polymerization by radiation is that it does not require a polymerization starting agent, whereby it becomes possible to make a surface layer having very highly dense cross-linking, and a good electrophotographic characteristic is secured. It can also be mentioned as an advantage that it is efficient polymerization reaction of a short time and is therefore high in productivity and further, the transmissibility of radiation is good and therefore the influence of the hindrance of hardening during film forming or when shielding material such as an additive is present in the film is very small.

However, depending on the kind of the chain polymerization group or the kind of the central skeleton, there is a case where it is difficult for polymerization reaction to progress, and in that case, the addition of the polymerization starting agent is possible within a range free of influence. The radiation used in this case is an electron beam and γ-ray. When an electron beam is applied, any one of a scanning type, an electro-curtain type, a broad beam type, a pulse type and a laminar type can be used as an accelerator.

When the electron beam is applied, the applying conditions are very important in making an electrical characteristic and durable performance revealed. In the present embodiment, an acceleration voltage should preferably be 250 kV or less, and optionally be 150 kV. Also, the dosage should preferably be a range of 1 Mrad-100 Mrad, and more preferably be a range of 1.5 Mrad-50 Mrad. If the acceleration voltage exceeds the above-mentioned level, the damage to the characteristic of the photosensitive member by the application of the electron beam tends to increase. Also, if the dosage is smaller than the above-mentioned range, hardening is liable to become insufficient, and if the dosage is greater than the above-mentioned range, the deterioration of the characteristic of the photosensitive member is liable to occur.

Also, the adjustment of the temperature of the photosensitive member during polymerization is an important item for controlling the degree of polymerization hardening and controlling a frictional characteristic. In the present embodiment, the temperature during polymerization may preferably be 50–150° C. If the temperature is lower than 50° C., much time is required for polymerization hardening, and this leads to an increase in cost or to a case where the polymerization hardening is insufficient. On the other hand, at a high temperature exceeding 150° C., there is a case where the influence of the rise or the like of residual potential by the damage to the ground charge transport layer to the undercoat layer comes out. More preferably, the temperature during polymerization is 130° C. or lower.

It is also preferable to control the surface shape by the above-described method such as polishing after up to the surface layer has been formed.

Now, the surface layer, as described above, has a function as a protective layer. The surface layer should preferably be thick in order to prevent the foundation such as the charge transport layer from becoming exposed due to a flaw or localized abrasion. On the other hand, a function as a window material for making various exposure lights transmitted to the charge generation layer is important to the surface layer. To suppress the loss of transmitted light by the absorption of the surface layer, and particularly the fluctuation of sensitivity and the broadening of the latent image by the scattering or the like of light as when fluorine containing resin is dispersed as a lubricant, the surface layer should preferably be thin.

Although depending on the abrasion resistance, hardness, light absorbing characteristic and scattering characteristic of the surface layer, the thickness of the surface layer should preferably be 0.5–10 μm, and more preferably be 1–7 μm.

[Physical Properties of the Surface Layer]

We have further progressed studies about the photosensitive member having the above-described surface layer to find that in view of the abrasion resistance of the photosensitive member and further, the damage or the like of the cleaning member, when a hardness test was effected under an environment of temperature 25° C. and humidity 50% by the use of a Vickers square pyramidal diamond indenter and the photosensitive member was indented at a maximum load of 6 mN, a photosensitive member of which HU (the value of universal hardness) is 150 N/mm$^2$ or greater and 220 N/mm$^2$ or less and the elastic deformation rate (We) is 43% or greater and 65% or less is preferable in suitably suppressing the abrasion resistance of the photosensitive member and further, the breakage or wear or the like of the cleaning member, to thereby obtain high durability as a system. The details thereof will hereinafter be described.

It is generally considered that the hardness of film is higher as the amount of deformation to extraneous stress becomes smaller and as a matter of course, an electrophotographic photosensitive member which is high in pencil hardness and Vickers hardness is improved in durability against mechanical deterioration. However, a photosensitive member which is high in the hardness obtained by the measurement of these could not always be expected to be improved in durability, and it has been found that the above-mentioned range is good.

The value of universal hardness (hereinafter referred to as HU) cannot be grasped separately from the elastic deformation rate, but when HU exceeds 220 N/mm$^2$, if the elastic deformation rate is less than 43%, paper dust, the developer, etc. adhere to the cleaning member, etc., and because the elastic force of the photosensitive member is deficient and because if the elastic deformation rate is greater than 65%, the amount of elastic deformation becomes small even if the elastic deformation rate is high, great pressure is locally applied as a result, and the flaw of the photosensitive member becomes liable to occur or the amount of abrasion increases. Or there is a case where the cleaning member is broken or worn out. Consequently, a photosensitive member having high HU is not always considered to be optimum as a photosensitive member.

Also, in the case of a photosensitive member of which the HU is less than 150 N/mm$^2$ and the elastic deformation rate exceeds 65%, even if the elastic deformation rate is high, the amount of plastic deformation also becomes great and the paper dust and the developer nipped between the photosensitive member and the cleaning member or the like are rubbed, whereby the photosensitive member is shaved or minute flaws occur thereto, and the durable life of the photosensitive member becomes short.

The HU and the elastic deformation rate were measured by the use of a minute hardness measuring apparatus Fischer Scope H100V (produced by Fischer Corp.) which can continuously apply a load to an indenter under an ordinary environment (temperature 25±2° C. and humidity 50±10%; hereinafter referred to as the N/N environment) and directly read the indentation depth under the load to thereby find continuous hardness. As the indenter, use was made of a Vickers square pyramidal diamond indenter having a facing angle of 136°. The condition of the load was measured stepwisely (at 273 points for a holding time of 0.1 sec. per point) up to the final load 6 mN.

Figure 4:
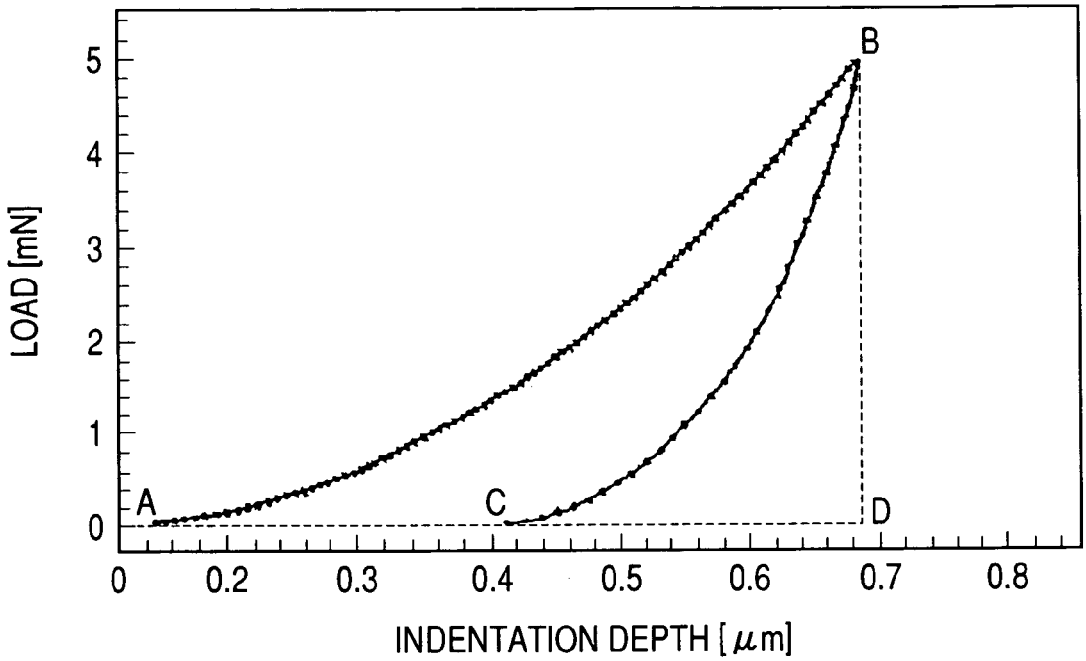
FIG. 4 is a graph showing an example of the relation between indentation depth measured by the use of Fischer scope H100V (produced by Fischer Corp.) and load.
Figure 5:
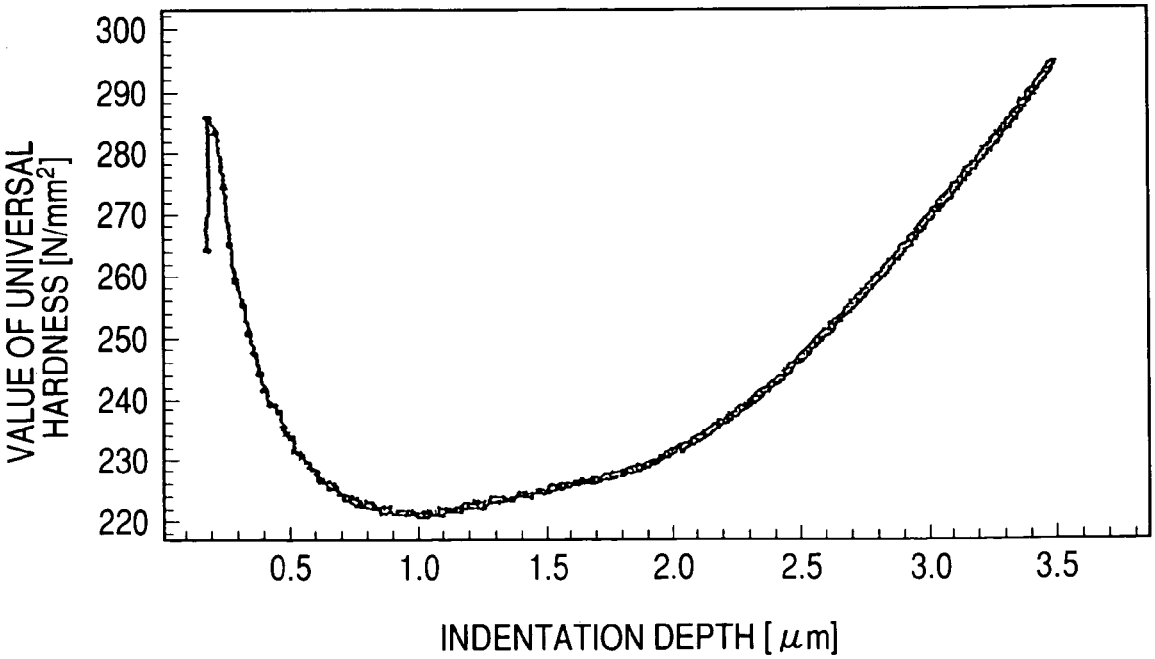
FIG. 5 is a graph showing an example of the relation between the indentation depth calculated from the graph shown in FIG. 4 and universal hardness.

FIG. 4 is a graph showing an example of the relation between the indentation depth measured by the Fischer Scope H100V (produced by Fischer Corp.) and the load. In FIG. 4, the axis of ordinates represents the load (mN) and the axis of abscissas represents the indentation depth h (μm), and this graph is the result of the load having been stepwisely increased and applied up to 6 mN, and thereafter having been likewise stepwisely decreased.

The HU is calculated from the indentation depth, a surface area found from the shape of the indenter, and a test load. From the graph of the indentation depth vs. test load shown in FIG. 4, there is obtained the graph of the indentation depth vs. HU shown in FIG. 5.

In the present invention, the HU is prescribed by the following expression (1) from the indentation depth vs. load, and from the indentation depth under the same load when indented at 6 mN.

$$Hu = \frac{\text{test load}(N)}{\text{surface area}(\text{mm}^2)\text{ of Vickers indenter in load test}} \quad \text{expression (1)}$$

$$= \frac{\text{test load}(N)}{26.43h^2}\ (N/\text{mm}^2)$$

$$= \frac{0.006}{26.43h^2}\ (N/\text{mm}^2)$$

$h$: indentation depth (mm) at test load

The elastic deformation rate was obtained from a work amount (energy) effected on the film by the indenter, i.e., a change in the energy by an increase or decrease in the load of the indenter to the film, and the value thereof is found from the following expression (2). The total work amount Wt (nW) is represented by the area surrounded by A-B-D-A indicated in FIG. 4, and the work amount W (nW) of the elastic deformation is represented by the area surrounded by C-B-D-C.

$$\text{Elastic deformation rate } We = W/Wt \times 100(\%) \quad \text{expression (2)}$$

To bring the characteristic of the surface layer of the photosensitive member into the range as described above, it is preferable that the surface layer be a protective layer formed of hardenable resin containing a charge transport compound and/or hardenable resin having a charge transporting function.

This is because by using hardenable resin, the degree of hardening of the hardenable resin can be adjusted, and it becomes easy to bring particularly the elastic deformation rate We into the above-described range. Also, the charge transport material is contained and the charge transporting function is given, whereby it is possible to suppress a reduction in sensitivity and the rise of residual potential and therefore, it is preferable for the charge transport material to be contained.

[Cleaning Apparatus]

Cleaning Member (Cleaning Blade)

The physical properties of the rubber of the cleaning member 107*a*, from the viewpoints of the stability of cleaning and the durability or the like of the cleaning member, may preferably be such that the cleaning member be an elastic blade having impact resilience of 5–60% and hardness of 20–85 degrees.

If the hardness is higher than 85 degrees, the local wear of the photosensitive member may occur or the cleaning property may be reduced. On the other hand, if the hardness is lower than 20 degrees, the cleaning member 107*a* becomes liable to be turned up. If the impact resilience is lower than 5%, the blade may be broken by the unevenness of the surface of the photosensitive member or foreign substances or the like, or the photosensitive member may be locally worn out. On the other hand, if the impact resilience is higher than 60%, the blade becomes liable to be dragged in the direction of movement of the photosensitive member, and the turning-up of the cleaning member 107*a* and the slipping-out of the developer become liable to occur. The hardness is measured on the basis of JIS K-6253 in terms of JIS-A hardness, and the impact resilience is measured on the basis of JIS K-6255.

Also, 1–4 mm is preferable as the thickness of the cleaning member 107*a*. If the cleaning member 107*a* is thinner than 1 mm, the physical properties of rubber such as hardness and impact resilience cannot be effectively used and faulty cleaning becomes liable to occur. On the other hand, if the cleaning member 107*a* is thicker than 4 mm, the photosensitive member may be locally worn out.

The cleaning member 107*a* may introduce a friction controlling member into at least a portion thereof which abuts against the photosensitive member. For example, nylon coating or alteration work by ultraviolet rays or the like may suitably be effected.

As a holding mechanism for the cleaning member 107*a*, a metal plate 107*e* is often used in the case of the afore-described tip blade type, and in the case of a sandwiching type, use is often made of a construction comprising a metal plate 107*e* made of a metal such as aluminum or SUS, a back plate, not shown, formed of phosphor bronze or the like and further, a spring 107*f* or the like for adjusting the abutting pressure of the cleaning member 107*a* against the surface of the photosensitive member.

As means for controlling the unevenness of the load applied to the cleaning member 107*a*, it is also effective to control the holding mechanism. By controlling the thickness, shape, fixed state and free length of the metal plate, and the abutting pressure, abutting angle, etc. thereof against the photosensitive member, it is possible to suitably disperse the load received by the cleaning member 107*a*, and substantially control the deviation of the frictional force of the cleaning member 107*a*.

It is also effective to use the adjustment of the free length and abutting angle or the like of the cleaning member 107*a* at the same time.

The free length and abutting angle of the cleaning member 107*a* may preferably be 2–10 mm and a range of 20–40°, respectively, in order to suitably maintain the abutting pressure and the distribution of the abutting pressure.

<Rubbing Member>

The cleaning means according to the present embodiment further has a rubbing member 107*b* for frictionally contacting with the photosensitive member to assist the cleaning member 107*a* in cleaning.

The rubbing member 107*b* is installed in contact with the photosensitive member, and is rotated by driving means (not shown). The rubbing member 107*b* rubs and removes any charged product on the photosensitive member 101 while being rotated on the upstream side of the cleaning member 107*a* with respect to the direction of rotation of the photosensitive member 101.

The rubbing member 107*b* functions also as a so-called auxiliary cleaning member for removing any untransferred developer and foreign substances such as paper dust on the photosensitive member 101, or as a member for suitably supplying a lubricant such as an extraneous additive to the portion of contact between the cleaning member 107*a* and the photosensitive member 101.

Also, the rubbing member 107*b* may suitably be designed to have a scraper 107*d* disposed thereon so as to remove the foreign substances removed from the photosensitive member 101 and any excess extraneous additive from the rubbing member 107*b*.

In addition to the rubbing force exerted on the photosensitive member 101 and the cleaning capability as the auxiliary cleaning member, the prevention of the photosensitive member 101 from being injured and durability are also mentioned as the important factors of the rubbing member 107*b*. Therefore, the rubbing member 107*b* should preferably be an elastic roller comprising an elastic member, or a member in the form of a fur brush roller formed of fiber.

Any material can be used as the constituent material of the elastic roller used in the present embodiment, but it is preferable to use a hydrophobic high molecular polymer having a high dielectric constant. If the elastic roller is electrically conductive, it is also preferable, for example, for the suppression of the stripping discharge or the like of the developer by being grounded.

The elastic roller is prepared by forming an elastic member of rubber or a foamed material as a flexible member on a mandrel. The elastic member is prescribed by resin such as urethane, a sulfidizing agent, a foaming agent or the like, and can be prepared by cutting or surface polishing as required after formed into a roller shape on a mandrel. This elastic roller may be either insulative or electrically conductive, and can also be resistance-adjusted by the use of a rubber material having an electrically conductive substance such as carbon black or a metal oxide dispersed therein, or an ionic conductive material having these foamed therein or having the electrically conductive substance not dispersed therein, or used with the electrically conductive substance.

As the material of the elastic roller, besides the elastic foamed material, mention may be made of an elastic material such as ethylene-propylene-dienepolyethylene (EPDM), urethane rubber or silicone rubber. Also, the surface of the elastic roller should also preferably have minute cells having an average cell diameter of 5–300 μm or unevenness in order to enhance the rubbing force or foreign substance removing capability. The cells may be closed cells or open cells.

The hardness of the elastic member used as the elastic roller should preferably be 5 degrees or greater and 30 degrees or less in terms of Asker-C hardness. If the hardness is less than 5 degrees, there is not a sufficient abrading force and therefore, the substances adhering to the surface cannot be removed. Also, in some cases, the elastic roller itself may be worn out and be reduced in its life. On the other hand, if the hardness is greater than 30 degrees, the surface of the photosensitive member will be injured to thereby reduce the life of the photosensitive member.

Also, any material can be used as the brush constituent material of the brush roller according to the present embodiment, but it is preferable to use a hydrophobic fiber forming high molecular polymer having a high dielectric constant.

As such a high molecular polymer, mention may be made, for example, of rayon, nylon, polycarbonate, polyester, resin methacrylate, acryl resin, polyvinyl chloride, polyvinylidene chloride, polypropylene, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, polyvinyl acetal (e.g. polyvinyl butyral) or the like.

These binder resins can be used singly or as a mixture of two or more kinds. Particularly preferable are rayon, nylon, polyester, acryl resin and polypropylene.

Also, the aforementioned brush may be either electrically conductive or insulative, and use can be made of a constituent material containing a low resistance substance such as carbon, and adjusted to arbitrary resistance. Also, the fiber of the fur brush may be in a straight hair state, or may have a loop shape.

The thickness of the single fiber of the brush used for the brush roller is 0.56 tex (5D) or greater and 3.33 tex (30D) or less. If the thickness is less than 0.56 tex, there is not a sufficient abrading force and therefore, the substances adhering to the surface cannot be removed. Also, if the thickness is greater than 3.33 tex, the fiber becomes rigid and therefore injures the surface of the photosensitive member to thereby reduce the life of the photosensitive member.

Here, "tex" is a numerical value obtained by measuring the weight of a length 1000 m of fiber constituting the brush at g (gram) unit, and is converted by tex=D/9 relative to "denier (D)" heretofore often used.

Also, the fiber density of the brush is $4\times10^2$f/cm$^2$ or greater and $20\times10^3$f/cm$^2$ or less. If the fiber density is less than. $4\times10^2$f/cm$^2$, unevenness will occur to the abrasion and the adhering substances cannot be removed uniformly. If the fiber density is greater than $20\times10^3$f/cm$^2$, the toner and the foreign substances which have come into among the fibers cannot be completely removed, and in some cases, packing may occur and the characteristic of the brush may be lost.

The rubbing member comprising the elastic roller, the fur brush or the like may be grounded to the earth or may have a suitable bias applied thereto.

[Photosensitive Member Temperature Controlling Means]

<Drum Heater>

A heater is mentioned as suitable means for controlling the temperature Td of the photosensitive member.

In FIG. 1, the photosensitive member 101 has a surface-shaped drum heater DH inside thereof. Inside the photosensitive member, besides the drum heater DH, there is a thermistor which is temperature measuring means (not shown) for measuring the surface temperature Td of the photosensitive member.

An output to the drum heater DH is controlled by the temperature measuring means and controlling means (not shown), whereby the surface temperature Td of the photosensitive member is maintained at a predetermined temperature.

Also, it is also preferable to install a non-contact temperature meter (not shown) or the like outside the photosensitive member and monitor the surface temperature of the photosensitive member 101. Also, besides the combination of the drum heater DH with the temperature measuring means and the controlling means, use may be made of a self-control type heater of which the resistance fluctuates at a predetermined temperature.

The drum heater DH is not restricted to the surface-shaped heater shown in FIG. 1, but may be provided by the central shaft of the photosensitive member being made into a bar-shaped heater or the like, and a well-known method can be used as temperature controlling means.

[Process Cartridge]

Figure 6:
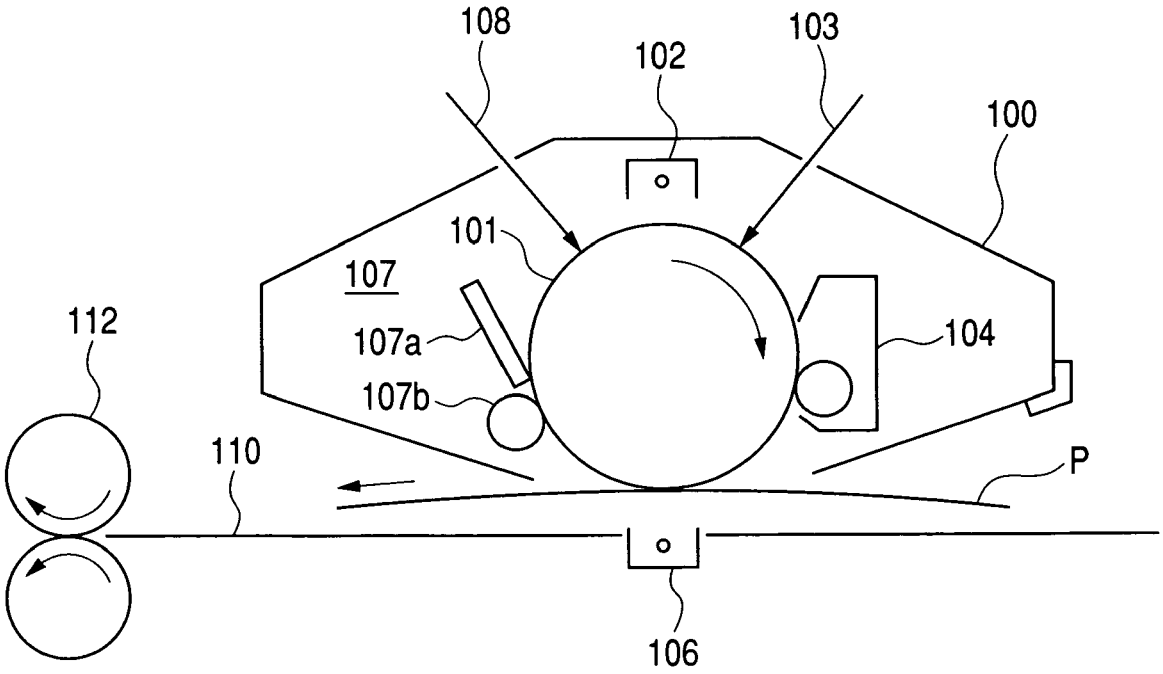
FIG. 6 is a typical cross-sectional view schematically showing a process cartridge detachably mountable on the image forming apparatus according to the embodiment of the present invention.

FIG. 6 is a typical cross-sectional view showing the epitome of a process cartridge detachably mountable on the image forming apparatus according to the present embodiment. As shown in FIG. 6, plural ones of such constituents as the photosensitive member 101, the primary charging means 102, the developing means 104 and the cleaning means 107 may be integrally coupled together as a process cartridge 100, which in turn may be constructed so as to be detachably mountable on the main body of an electrophotographic type image forming apparatus such as a copying machine or a laser beam printer.

For example, at least one of the primary charging means 102, the developing means 104 and the cleaning means 107 can be supported integrally with the photosensitive member 101 and be made into a cartridge, thereby providing the process cartridge 100 detachably mountable on the apparatus main body by the use of guide means such as the rail of the apparatus main body. As the charging means 102, a corotron type, a scorotron type, a contact charging type or the like can be arbitrarily selected.

[Developer]

The developer includes a classified article, i.e., toner particles, which are a base material comprising a colorant, resin, etc., and an extraneous additive extraneously added around the classified article. A two-component developer further includes a carrier.

As the developer, i.e., the toner particles, a small particle diameter such as an average particle diameter of about 9 μm or less is preferable in order to cope with high resolution (high dpi) or the like. Also, from the viewpoint of a high quality of image, a two-component developer is preferably utilized. As the developer in the present embodiment, use can be made of a well-known developer corresponding to the foregoing.

The average particle diameter of the toner of the developer is defined by a weight average particle diameter, and the preferable range of this weight average particle diameter is 3–9 μm. The use of a toner in this range is preferable from the viewpoint of maintaining the quality of image and cleaning good.

Regarding a toner of which the weight average particle diameter is less than 3 μm, the surface area of the entire toner increases and in addition, the fluidity and agitatability as a powder material are lowered and fog or transferrability tends to be aggravated, and this is liable to cause the non-uniformity of an image besides fusion, and further, the untransferred toner on the photosensitive member becomes more due to a reduction in transfer efficiency, and a local shock to the cleaning blade becomes excessive and thus, the cleaning property and the suppression of toner fusion become difficult to attain.

Also, when the weight average particle diameter exceeds 9 μm, scatter is liable to occur to characters and line images, and high resolution is difficult to obtain. Further, as the apparatus becomes higher in resolution, the reproduction of one dot tends to be aggravated in the case of a toner of 10 μm or greater.

Also, as the magnetic carrier used in the two-component developer, use can be made of a resin carrier of a magnetic material dispersed type, a magnetic carrier of a single magnetic material such as ferrite or a resin carrier of a magnetic material dispersed type having its surface coated with resin, or the like.

Also, it is preferable that the toner in the present embodiment have at least one heat absorption peak in a temperature area of which the glass-transition temperature Tg is 40–90° C. (preferably 50-70° C.), in the DSC curve during temperature rise measured by a differential scanning calorimeter (DSC). If Tg is too lower than the above-mentioned range, the toner is liable to be deteriorated under a high temperature atmosphere, and offset becomes liable to occur during fixing. Also, if Tg is too higher than the above-mentioned range, the fixing property tends to lower.

To obtain a toner having a heat absorption peak of the above-mentioned range, wax having a heat absorption peak at 40–90° C. in the DSC curve during the temperature rise measured by the differential scanning calorimeter (DSC) can be contained in the toner.

By having the heat absorption peak within this range, the fixing property and anti-offset property of the toner can be improved. The measurement of the heat absorption peak temperature of the toner is effected in accordance with ASTM standard D3418-82 by the use of, for example, DSC-7 (produced by Perkin-Elmer Corp.) or DSC 2920 (produced by TA Instrument Corp. Japan). As DSC curve, use is made of DSC curve measured when the temperature was once raised and dropped to thereby take a pre-history, and thereafter was raised at a temperature rising speed of 10° C./min. In the present embodiment, DSC-7 was used and measurement was effected under the following conditions.

Sample: 5–20 mg, preferably 10 mg

Measuring method: the sample is put into an aluminum pan, and an empty aluminum pan is used as reference.

Temperature curve: temperature rise I (20° C.→180° C., raised temperature 10° C./min.)

Temperature drop I: (180° C.→10° C., temperature drop speed 100° C./min.)

Temperature rise II: (10° C.→180° C., temperature rise speed 10° C./min.)

In the above-described measuring procedure, the point of intersection between the line at the intermediate point on a base line before and behind the heat absorption peak and the differential heat curve is defined as the glass-transition temperature Tg in the present embodiment by the use of the heat absorption peak measured at the temperature rise II.

The effect of the present invention will hereinafter be described specifically with respect to some embodiments. The present invention is not restricted to these embodiments.

[First Embodiment]

A photosensitive member having a surface layer according to this embodiment was prepared as follows.

First, regarding layers under the surface layer including a supporting member, a photosensitive member of which the undercoat layer is 2 μm, the film thickness of the charge generation layer is 2 μm, and the thickness of the charge transport layer is 13 μm was prepared by the same prescription as that of a product drum for CP680 produced by Canon Inc.

<1. Manufacture of a Hardened Type Surface Layer>

<1-1. Basic Type of a Radiation-Hardened Type Surface Layer>

The prescription of the surface layer is shown in Table 1 below. As a raw material, use was made of a polymerizable charge transport compound of the construction of the following expression (M1). In case of the production of this compound, refinement was suitably effected through a silica gel column to thereby remove impurities.

(M1)

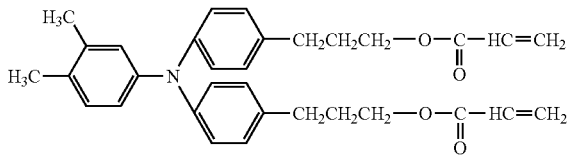

On the other hand, as a lubricant, use was made of tetrafluoroethylene resin which is fluorine containing resin.

In the present embodiment, as a lubricant to be contained in the photosensitive layer, 26 mass parts (hereinafter simply referred to as "parts") of tetrafluoroethylene resin particles (Lublon L-2, produced by Daikin Industry Co., Ltd.: hereinafter simply referred to as Teflon (registered trade mark) resin) and 50 parts of monochlorobenzene were dispersed by a sand mill apparatus using glass beads. The above-mentioned charge transport compound was added by 60 parts to this tetrafluoroethylene resin particle dispersed liquid and dissolved, whereafter 30 parts of dichloromethane were added thereto to thereby prepare paint for the surface layer.

This paint was applied onto the aforedescribed photosensitive member, and an electron beam was applied thereto under the conditions of an accelerating voltage of 150 kV, a dose of 5 Mrad and a photosensitive member surface temperature of 110° C. to thereby harden the resin and form a hardened surface layer having a film thickness of 5 μm, thus obtaining an electrophotographic photosensitive member K0.

<1-2. Amount of Teflon (Registered Trade Mark), Amount of Electron Beam and Photosensitive Member Surface Temperature Conditions>

The conditions of the Teflon (registered trade mark) resin content amount, the amount of electron beam and the surface temperature of the photosensitive member during the manufacture thereof were allotted to the photosensitive member K0 prepared under item <1-1> above to thereby prepare photosensitive members K1–K20.

<1-3. Charge Transport Material>

In contrast with the photosensitive members prepared under item <1–2> above, photosensitive members K21–30 further containing the following charge transport compounds M2 and M3 were prepared.

(Charge Transport Compound M2)

(M2)

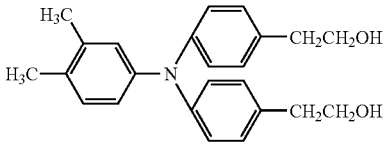

(Charge Transport Compound M3)

(M3)

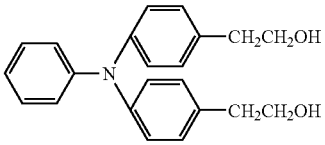

<2. Non-magnetic Two-Component Developer>

As a color developer, a two-component developer was prepared in the following manner.

<2-1. Carrier>

As a carrier for the two-component developer used in the present embodiment, use may be made of a well-known ferrite carrier, or a novel carrier as described below.

In the present embodiment, carrier particles are a spherical polymerized carrier, and as regards a method of manufacturing the same, a monomer composition having binder resin and a magnetic metal oxide and a non-magnetic metal oxide or the like added to a monomer by a polymerizing method was suspended in a water medium, and was polymerized to thereby obtain carrier particles of a spherical shape (the producing method is not restricted to the above-described technique, but may be an emulsion polymerizing method or the like, and other additives may be added).

<2-1-1. Example of the Manufacture of the Carrier>

5.5% by weight of silane coupling agent (3-(2-aminoethyl aminopropyl) dimethoxysilane) was added to each of magnetite powder ($FeO.Fe_2O_3$) which is a ferromagnetic material having a number average particle diameter of 0.24 μm, and $\alpha$-$Fe_2O_3$ powder which is a non-magnetic material having a number average particle diameter of 0.60 μm, and they were rapidly mixed and agitated at 100° C. or higher in a container to thereby carry out the lipophilic processing of each metal oxide fine particle.

Then, the following composition (C1) including the above-mentioned metal oxide fine particles was put into a flask containing therein a water medium consisting of water including 28% by weight of $NH_4OH$ water solution, and they were raised to a temperature of 85° C. for 40 minutes while being agitated and mixed, and were reacted and heat-hardened for 3 hours while this temperature was maintained. Subsequently, they were cooled down to 30° C., and water was further added thereto, whereafter the supernatant liquid was removed, and the deposit was washed by water and dried by air. Thereafter, it was dried at 50–60° C. under reduced pressure (5 mmHg or less) to thereby obtain a magnetic resin carrier by the polymerizing method.

Composition (C1)

phenol . . . 10 parts by weight formaldehyde solution (40% by weight of formaldehyde, 10% by weight of methanol, and 50% by weight of water) . . . 6 parts by weight magnetite powder subjected to lipophilic processing . . . 60 parts by weight $\alpha$-$Fe_2O_3$ powder subjected to lipophilic processing . . . 40 parts by weight, and further, with the foregoing obtained magnetic resin carrier as core particles, the surface of this was coated with heat-hardenable silicone resin by the following method.

A coat solution including 10% by weight of silicone resin material was prepared with toluene as a solvent so that the amount of coat resin on the surface of the magnetic carrier might be 1.0% by weight. The solvent was volatilized while shearing stress was continuously applied to this solution to thereby effect the coating of the surfaces of the core particles. Next, the magnetic carrier coated with the coat solution was cured at 200° C. for an hour, and was pulverized, and thereafter was classified by a sieve of 200 meshes to thereby obtain a magnetic resin carrier C of a magnetic material dispersed type having its surface coated with silicone resin.

When the particle diameter of the thus obtained magnetic resin carrier C was measured, the number average particle diameter measured by an image processing and analyzing apparatus Luzex 3 produced by Nireco Corporation was 28.3 μm. Also, the intensity of magnetization at 1 kilooested was 129 emu/cm$^3$. The intensity of the magnetization was measured by a vibration magnetic field type magnetic characteristic automatic recording apparatus BHV-30 produced by Riken Denshi Ltd.

<2-2. Non-magnetic Toner>

<2-2-1. Manufacture of Non-magnetic Toner>

900 parts by weight of ion exchange water and 100 parts by weight of polyvinyl alcohol were poured into a four-mouth flask provided with a high-speed agitating apparatus TK-homomixer, and the number of revolutions thereof was adjusted to 1200 rpm, and the flask was heated to 60° C. to thereby prepare a water medium. On the other hand, the following composition (T1) was mixed and the mixture was heated to 60° C., and was agitated at a number of revolutions 12000 rpm by the use of a TK type homomixer (produced by Tokushu Kika Kogyo Co.). Further, a polymeric monomer composition having 3 parts by weight of 2-azobisisobutyronitrile dissolved in the mixture was poured into the previously prepared water medium, and was agitated under a nitrogen stream at 10000 rpm for 10 minutes by the TK type homomixer, and thereafter was raised to a temperature of 80° C. while being agitated by a paddle agitating blade, and was reacted for 10 hours. After the termination of the polymerizing reaction, any residual monomer was removed under reduced pressure, and after cooling, hydrochloric acid was added and calcium phosphate was dissolved, whereafter it was filtrated, washed by water and dried to thereby obtain a polymer toner T. Here, an example of the manufacture of a black toner will be shown.

Composition (T1)

styrene monomer . . . 90 parts by weight
n-butylacrylate monomer . . . 22 parts by weight
carbon black . . . 10 parts by weight
metal compound salicylate . . . 1 part by weight
releasing agent . . . 20 parts by weight Subsequently, 0.9 parts by weight of the above-mentioned polymer toner was dispersed in 5.0 parts by weight of methanol, whereafter 0.5 part by weight of tetraethoxysilane and 0.3 part by weight of methyltriethoxysilane were dissolved as a silicon compound and further, 50 parts by weight of methanol was added. Subsequently, a solution having 100 parts by weight of methanol added to 10 parts by weight of water solution of 28% by weight of $NH_4OH$ was added thereto while being dripped, and was agitated at room temperature for 48 hours.

After the termination of reaction, the obtained particles were washed by refining water, and then washed by methanol, whereafter the particles were filtrated and dried to thereby obtain toner particles T having an average particle diameter of 6.5 μm and a shape coefficient SF1 of 1.06. This toner was Tg=65° C.

<2-2-2. Manufacture of Extraneous Additive>

On the other hand, as inorganic fine particles for use as an extraneous additive, silica having a number average primary particle diameter of 9 nm was treated by hexamethyldisilazane, and thereafter was treated by silicone oil to thereby prepare a hydrophobic silica fine powder material having a BET value of 200 m$^2$/g after the treatment.

Besides this, use can be made of fluorine resin powder such as vinylidene fluoride fine powder or polytetrafluoroethylene fine powder, fine powder silica such as wet type manufacturing method silica or dry type manufacturing method silica, fine powder titanium, fine powder alumina, treated silica obtained by surface-treating these by a silane coupling agent, a titanium coupling agent or silicone oil and giving them a hydrophobic property, treated titanium oxide, treated alumina or the like.

<2-2-3. Extraneously Adding Step>

As an extraneous additive, 1.0 part of hydrophobic silica fine powder material was added to 100 parts by mass of toner particles, and they were mixed for 3 minutes with the peripheral speed of agitating vanes as 40 m/sec. by the use of Henschel mixer produced by Mitsui Miike Kakoki Co., Ltd., to thereby prepare a non-magnetic toner T.

<2-3. Developer>

As the developer, the above-described magnetic resin carrier C and the non-magnetic toner T were mixed together so as to be T/C=8% in terms of mass ratio, and were sufficiently agitated to thereby prepare a developer for a developing device. Also, the non-magnetic toner T was used as a developer for supply during endurance.

2-4. Evaluating Apparatus

For the evaluation of the electrophotographic photosensitive member prepared above, the cleaning means including the rubbing member, and the photosensitive member temperature controlling means, CP680 produced by Canon Inc., IR6000 produced by Canon Inc., and CLC5000 produced by Canon Inc. were remodelled and used.

CP680 was such that the developing means was two-component developing means with the positions of the developing means, the transferring means, etc. remaining in the state of the products, and the rubbing member and driving means for the rubbing member were installed upstream of the cleaning member of the cartridge. A surface-shaped heater and a thermistor were provided in the interior of the photosensitive member to thereby make the temperature of the photosensitive member controllable. Also, the charging means were changed to a scorotron.

Also, as regards IR6000, the developing means was changed to a two-component developing type, and further the image forming apparatus was changed to the color image forming apparatus as shown in FIG. 1 so that a magnet roller in the cleaning means might enable a discrete rubbing member to be mounted thereon, and further this rubbing member was made drivable. Also, the changing or the like of the polarity of a power source was effected so that image forming could be done by reversal developing by the use of a negatively chargeable photosensitive member.

Figure 7:
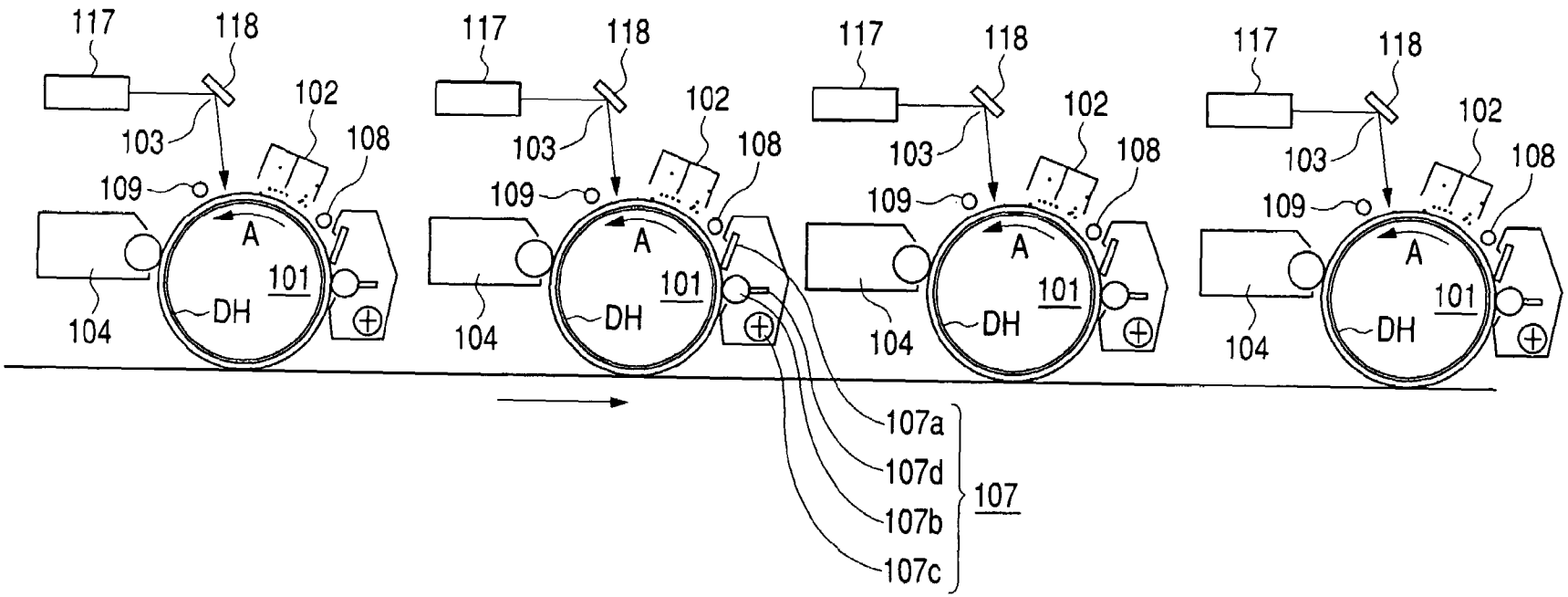
FIG. 7 is a typical cross-sectional view of an image forming apparatus according to another embodiment of the present invention.

Also, as regards CLC5000, a cleaning portion was upwardly shifted as shown in FIG. 7 so that a drivable rubbing member could be installed.

Regarding IR6000 and CLC5000, as photosensitive member temperature Td controlling means, an existing heater was diverted to the products IR6000 and CLC5000, and this heater control circuit was partly remodelled and used.

In any of the above-described evaluating apparatuses, the developer was the aforedescribed oil-less two-component developer (consisting of a non-magnetic was inwardly added toner having an extraneous additive, and a magnetic carrier), and the fixing means was remodeled so as to be adapted for this developer. Also, the surface speed of the photosensitive member was made adjustable. As a matter of course, paper conveyance, the developing means, the transferring means, etc. have their speeds adjusted in synchronism with the surface speed of the photosensitive member. Also, design was made such that the untransferred toner, paper dust, etc. collected by the cleaning means were collected into a waste toner box (not shown) by carrying means such as waste toner carrying means 107*c*. Further, the adjustment of the exposure amount and the charging condition, and the remodeling for enabling a potentiometer to be installed were effected so that potential evaluation could be done. As the potentiometer, use is made of 344, 555P-1 produced by TRek Inc., and it is installed at the position of the developing means by a jig for exclusive use to thereby measure potential.

<3. Rubbing Member>

As a rubbing member to be installed in the above-described evaluating apparatus, an elastic roller DR1 formed of foamed urethane having carbon dispersed therein was prepared on a mandrel of ϕ8 by a well-known method. This elastic roller DR1 has a number of closed cells having an average pore diameter of ϕ100 μm. Asker-C hardness was 20 degrees, and the elastic roller was installed so as to displace or inroad into the photosensitive member by 0.5 mm. Also, in the cleaning apparatus, a scraper was prepared and installed so as to inroad into the elastic roller by 0.2 mm.

Also, with rayon of 2 tex (18D) having carbon dispersed therein at $9.3\times10^3$f/cm$^2$ (60 kf/inch$^2$), a brush roller BR1 was prepared so as to inroad into the photosensitive member by 1.5 mm. Also, in the cleaning apparatus, a scraper was prepared so as to enter into this brush roller by 0.5 mm, and was installed so as to abut against the photosensitive member in parallel therewith.

The elastic roller and the brush roller were driven so as to rotate at any surface speed in synchronism with the driving of the photosensitive member.

The driving condition of this rubbing member is indicated by a relative speed [%] to the surface peripheral speed S of the photosensitive member. It is to be noted that + is a forward direction relative to the photosensitive member, and—is a counter direction, and for example, +100% refers to a state in which the rubbing member rotates with the photosensitive member at the same speed as the latter, 0% refers to a stopped state, and −100% refers to a state in which the rubbing member is rotated in the counter direction at the same speed as the surface speed of the photosensitive member.

Also, the absolute value ΔS [m/sec.] of the relative speed difference between the photosensitive member and the rubbing member is calculated from the surface peripheral speed S of the photosensitive member and the relative speed difference.

<4. Evaluation [Universal Hardness Value HU and Elastic Deformation Rate We of the Drum]>

Regarding the electrophotographic photosensitive member prepared as described above, the initial electrophotographic characteristic and the electrophotographic characteristic and image during repetitive use were evaluated. A plurality of photosensitive members were prepared by the same prescription in order to be used for the measurement of the universal hardness HU and the elastic deformation rate We and for a wear resistance test.

The initial electrophotographic characteristic and durability were evaluated with the photosensitive member mounted on the remodeled machine of the above-mentioned IR6000 (hereinafter referred to as IR6000), the remodeled machine of the above-mentioned CLC5000 (hereinafter referred to as CLC5000) and the remodeled machine of the above-mentioned CP680 (hereinafter referred to as CP680) produced by Canon Inc. The surface speed of the photosensitive member was that of the product.

The cleaning member (the blade and the method of supporting the blade) was as it was produced. Also, use was made of the elastic roller DR1 prepared in item <3> above and the cleaning apparatus having a scraper, and they were rotated in the forward direction relative to the photosensitive member at a relative speed 70% to the surface speed S of the photosensitive member.

Endurance was tested for 4,000 sheets of A4-size paper at intermittence of one sheet with a main switch turned on in the morning, and the main switch was turned off at night. Also, the surface temperature Td of the photosensitive member was raised to 40±2° C. during the warm-up of the evaluating apparatus after the turn-on of the main switch so as to be maintained within the above-mentioned temperature range during the turn-on of a main body source (main ON), and in such a state, the evaluation of the initial electrical characteristic of the photosensitive member and the evaluation of the hardness and physical properties were carried out.

For the evaluation of the initial electrical characteristic of the photosensitive member, the developing means was detached, a potentiometer was installed, an electric current of −800 μA was let to flow to the wire of the scorotron which is the charging means, and a suction power source was used for a grid so that a voltage of −600V might be applied. In this state, dark portion potential Vd was measured. Next, the applied voltage to the grid was adjusted and the dark portion potential was set to −600V, and as a quantity of light necessary to be light-attenuated to −150V, V1 sensitivity and residual potential Vs1 as the potential when a quantity of light three times as great as the sensitivity was applied were measured.

For the evaluation of the electrical characteristic, for reference, CTL (charge transport layer) was prepared so as to have a thickness equal to that of CTL of K0–K30+surface layer, and a photosensitive member NSL (No Surface Layer) having no surface layer made thereon was likewise evaluated.

As a result, the photosensitive members K0–K30 prepared in the present embodiment had a charging characteristic, a sensitivity characteristic and a residual electric characteristic equal to those of the NSL, and did not suffer from a reduction in sensitivity and an increase in Vs1 due to the surface layer, and exhibited a good electrical characteristic.

Regarding these photosensitive members K0–K30, the universal hardness value HU and the elastic deformation rate We were measured by the use of a minute hardness measuring apparatus Fischer scope H100V (produced by Fischer Corp.).

Subsequently, a wear resistance test (a plate life or plate wear test) was carried out about each of K0–K30.

In the evaluating apparatus, the developing means was returned and a photosensitive member of the same prescription as one of which the electrical characteristic, HU and We were measured was installed. In this N/N environment, the passing endurance test of 40,000 sheets was carried out and further, about the photosensitive member after the endurance, the passing endurance test of 30,000 sheets each, thus 100,000 sheets in total, was carried out under an (H/H) environment of temperature 30° C./humidity 80% and under an (L/L) environment of temperature 10° C./humidity 15%.

During the endurance, for 2,000 sheets each, the visual observation of the flaw and roughness of the photosensitive member, and the presence or absence of the image defect, cleaning property and streaks of an image sample was effected.

As regards the image defect of the image sample, streak-like, band-like or localized image non-uniformity by the flaw, abrasion or the like of the surface of the photosensitive member was evaluated. Also, the flaw of the surface of the photosensitive member was measured about any twelve points on the surface of the photosensitive member and locations thereon at which a flaw or a streak was visually perceived, by the use of a surface roughness measuring machine (Surfcorder SE-3400 produced by Kosaka Research Institute under JIS 1982 mode, a measuring speed of 0.1 mm/sec., a measuring length of 5 mm and cut-off $\lambda c$=0.8 mm.

As regards the cleaning property, the filming and slipping-away by faulty cleaning and the vibration sound and resonance sound of the cleaning member were evaluated.

As regards the streak, the presence or absence of streak-like image defects forming halftones of a single color and four mixed colors by vertical lines of 300 μm was evaluated.

Further, the aforementioned characteristics of the photosensitive member were measured for 10,000 sheets each, and an amount of change ΔVd in dark portion potential Vd by endurance and an amount of change ΔVs1 in residual potential Vs1 were found by the difference in potential, and the ratio Δ sensitivity ratio of an amount of change A sensitivity in v1 sensitivity to the initial sensitivity.

Also, of the results of measurement, before and after endurance, the edge portion of the cleaning member was microscopically observed and the wear level was evaluated.

Likewise, before and after endurance, the amount of abrasion of the photosensitive member was measured. The amount of abrasion was measured by the use of an eddy current type film thickness measuring machine (PERMA SCOPE TYPE E111 produced by Fischer Corp.), and was calculated as the abrasion Rate [$10^{-6}$ μm/rotation] per one full rotation.

The evaluation standard is as follows. In case of the evaluation of each defect, simultaneously with the judgment on the image, the film thickness and surface shape of the photosensitive member, the degree of contamination of the surface of the photosensitive member after having passed the cleaning blade, the charging means and the cleaning means, etc. were evaluated. From the result of these evaluations, the factors of the image defects were judged. Even if streaks occurred on the image, the following evaluation items were judged in conformity such factors as flaw, faulty cleaning and streak-like defect.

Image Defect (Flaw)

As regards the image defects by the flaw of the photosensitive member, the size and number thereof were measured from a blank copy image, a solid black image and a two-tone image, in an image having the greatest number of streak- or band-like defects having a width of 0.1 mm or greater, the number of the defects in a sheet of A3-size paper was counted and at the same time, the result of the surface observation of the photosensitive member was judged. The judgment standard is as follows.

◎: Very good on both of the surface of the photosensitive member and the image.

○: on the surface of the photosensitive member, there is a defect of a maximum height Rz (Rmax referred to in the present measurement, i.e., JISO601: 1982) equal to or greater than 1.5 μm, but it does not appear in the image/good.

●: Image defects within a length of 10 mm and within a width of 0.5 mm are seen within five locations on the image. Further, there is no image defect exceeding a length of 10 mm or exceeding a width of 0.5 mm/practically usable.

x: Others (Image defects are seen at five or more locations. Or there is an image defect having a length of 10 mm or greater, or exceeding a width of 0.5 mm)/practically problematic.

Image Defect (Developer Fusion)

As regards the evaluation of black spots and white spots by developer fusion, the size and number thereof were measured from a halftone, a solid white image, a solid black image and a two-tone image, and in an image having the greatest number of black spots or white spots of 0.1 mm or greater, the number thereof present in a sheet of A3-size paper was judged. The judgment standard is as follows.

◎: Good on both of the surface of the photosensitive member and the image.

○: The number of spots within 0.1 mm is within three on the image, and no spot of 0.3 mm or greater./practically usable.

●: The number of spots within 0.3 mm is within five on the image, and no spot of 0.5 mm or greater./practically usable.

x: Others (there are more than four spots or spots of 0.5 mm or greater./practically problematic.

Faulty cleaning (slipping-away, vibration sound, resonance sound, turning-up)

Regarding faulty cleaning, streak-like slip-away image defects (evaluated by halftone, solid blank image, solid black image and two-tone image) were visually evaluated. Filming-like slip-away was measured by the use of a reflection density meter (REFLECT METER MODE LTC-6D(S) produced by TOKYO DENSHOKU Ltd.), and (Ds-Dr) when the minimum value of the reflection density of a white ground portion after image printing was defined as Ds and the average value of the reflection density of paper before image printing was defined as Dr was adopted as a filming amount.

Also, the presence or absence of the occurrence of turning-up, vibration sound, slip-away and resonance sound was evaluated. The judgment standard is as follows.

◎: Filming is less than 3%. No slip-away. No turning-up, vibration sound and resonance sound./good.

○: Filming is 3% or greater and less than 4%. No slip-away. Or within two streak-like defects having a width less than 0.3 mm and a length less than 1 mm. No turning-up, and resonance sound sometimes occurs during the stoppage of the photosensitive member. Or vibration sound sometimes occurs (the frequency of the occurrence thereof is small)./practically usable.

●: Filming is 4% or greater and less than 5%. No slip-away. Both of resonance sound and vibration sound sometimes occur (the frequency of the occurrence thereof is small)./the lower limit of practical usability.

x: Others. Filming is 5% or greater, or slip-away is present. Or slip-away occurs three or more times, or a width of 0.3 mm or greater, or a length of 1 mm or greater. Or turning-up sometimes occurs. Vibration sound and resonance sound or the frequency of the occurrence thereof is high./practically problematic.

Wear by Cleaning

After the wear resistance test, the cut surface and abutting surface of the cleaning blade were microscopically observed and the breakage and scrape of the cleaning blade were evaluated. The judgment standard is as follows.

◎: No breakage of the blade. Scrape or breakage equal to or less than the particle diameter of the toner is perceived within three locations. No faulty cleaning./good.

○: Scrape or breakage equal to or less than the particle diameter of the toner is perceived at four to five locations. No scrape larger than the particle diameter of the toner.

●: Scrape or breakage equal to or less than the particle diameter of the toner is perceived at six or more locations. Scrape or breakage larger than the particle diameter of the toner is present. No faulty cleaning./practically usable.

x: Others. Faulty cleaning due to the wear of the blade such as scrape/breakage occurs./practically problematic.

Black-Lined Defective Image

As regards black-lined defective images, the size and number thereof were measured from halftone, a blank copy image, a solid black image and a two-tone image, and judgment was done by the number thereof in a sheet of A3-size paper, in an image having the greatest number of streak- or band-like defects having a width of 0.1 mm or greater. Also, image density was measured at absolute density, and the image during the evaluation of each image was measured by the use of a density meter "RD-918" (produced by Macbeth Co., Inc.). Generally in endurance, the solid black image secured density of 1.3 or greater. The judgment standard is as follows.

◎: In the image, there is no streak-like defect./very good.

○: Streak is present, but the streak-like defect is one in which the image density difference between the streak portion and a non-streak portion near it is less than 0.1, and image defects having a length within 10 mm and a width within 0.5 mm are present within five locations in the image. Further, there is no image defect exceeding a length of 10 mm or a width of 0.5 mm.

●: Streak is present, but image defect in which the image density difference between the streak portion and a non-streak portion near it is 0.1 or greater and less than 0.2 and of which the length is within 10 mm and the width is within 0.5 mm is present within five locations in the image. Further, there is no image defect exceeding a length of 10 mm or a width of 0.5 mm./practically usable.

x: Others (the image density difference between the streak portion and the non-streak portion near it is 0.2 or greater, or image defect is present at five or more locations. Or there is an image defect having a length of 10 mm or greater, or exceeding a width of 0.5 mm) or there occurs a so-called image deletion in which characters are blurred./practically problematic.

The Film Thickness Decrease Amount Difference of the Photosensitive Member

The film thickness abrasion of each photosensitive member before and after the wear resistance test was measured.

As regards the measurement of the film thickness of the photosensitive member, the uniform film thickness portion of the photosensitive layer was measured circumferentially at eight locations and axially at three locations, thus at twenty-four locations in total, and the average value thereof was adopted as the film thickness of the photosensitive layer. As a film thickness measuring machine, use was made of an eddy current type film thickness measuring machine EDDY 560C (produced by HELMUT FISCHER GMBTECO). As regards the calculation of the abrasion amount, Δd found by |film thickness of photosensitive member after termination of wear resistance test of 100k sheets|−|film thickness of photosensitive member at start|=abrasion amount Δd(μm) was divided by the number of revolutions of the photosensitive member to thereby calculate it as the abrasion rate per one full rotation [$10^{-6}$ μm/(rot)]. The judgment standard is as follows.

◎: The abrasion rate is less than 20[$10^{-6}$ μm/rot]. No localized abrasion/good.

○: The abrasion rate is 20 or greater and less than 40 [$10^{-6}$ μm/rot]. No localized abrasion/practically usable.

●: The abrasion rate is 40 or greater and within 50[$10^{-6}$ μm/rot]. Or localized abrasion is present. However, there is no region in which the surface layer has disappeared after the termination of the wear resistance test./the lower limit of practical usability.

x: Others. The abrasion rate is greater than 50[$10^{-6}$ μm/rot], or abrasion progressed to the ground after the wear resistance test./practically problematic.

The physical properties of the photosensitive member and the evaluating conditions by IR6000 remodelled machine hitherto described are shown in Table 1 below. In Table 1, A=ΔS×Ps. In the succeeding tables as well, unless particularly described, A is similarly defined.

TABLE 1

| | Surface layer | | | | | abutting | | | | | | |
|---|---|---|---|---|---|---|---|---|---|---|---|---|
| photosensitive member | charge transporting | charge transport | HU | We | speed S | auxil-iary | pressure PS | driving speed | ΔS | Td | | |
| No. | function | material | [N/mm$^2$] | [%] | [mm/sec] | member | [gf/cm] | [%] | [mm/sec] | [° C.] | [K] | A × Td/S$^2$ |
| K 0 | M1 | without | 180 | 48 | 265 | DR1 | 30 | 70% | 79.5 | 40 | 313.15 | 1.065E+01 |
| K 1 | ↑ | ↑ | 150 | 65 | ↑ | ↑ | ↑ | ↑ | ↑ | ↑ | ↑ | ↑ |
| K 2 | ↑ | ↑ | 152 | 62 | ↑ | ↑ | ↑ | ↑ | ↑ | ↑ | ↑ | ↑ |
| K 3 | ↑ | ↑ | 160 | 57 | ↑ | ↑ | ↑ | ↑ | ↑ | ↑ | ↑ | ↑ |
| K 4 | ↑ | ↑ | 170 | 55 | ↑ | ↑ | ↑ | ↑ | ↑ | ↑ | ↑ | ↑ |
| K 5 | ↑ | ↑ | 180 | 53 | ↑ | ↑ | ↑ | ↑ | ↑ | ↑ | ↑ | ↑ |
| K 6 | ↑ | ↑ | 190 | 50 | ↑ | ↑ | ↑ | ↑ | ↑ | ↑ | ↑ | ↑ |
| K 7 | ↑ | ↑ | 200 | 48 | ↑ | ↑ | ↑ | ↑ | ↑ | ↑ | ↑ | ↑ |
| K 8 | ↑ | ↑ | 210 | 47 | ↑ | ↑ | ↑ | ↑ | ↑ | ↑ | ↑ | ↑ |
| K 9 | ↑ | ↑ | 217 | 43 | ↑ | ↑ | ↑ | ↑ | ↑ | ↑ | ↑ | ↑ |
| K10 | ↑ | ↑ | 220 | 40 | ↑ | ↑ | ↑ | ↑ | ↑ | ↑ | ↑ | ↑ |
| K11 | ↑ | ↑ | 148 | 64 | ↑ | ↑ | ↑ | ↑ | ↑ | ↑ | ↑ | ↑ |
| K12 | ↑ | ↑ | 100 | 65 | ↑ | ↑ | ↑ | ↑ | ↑ | ↑ | ↑ | ↑ |
| K13 | ↑ | ↑ | 223 | 41 | ↑ | ↑ | ↑ | ↑ | ↑ | ↑ | ↑ | ↑ |

TABLE 1-continued

| photosensitive member No. | Surface layer charge transporting function | Surface layer charge transport material | HU [N/mm$^2$] | We [%] | abutting speed S [mm/sec] | abutting auxiliary member | abutting pressure PS [gf/cm] | abutting driving speed [%] | ΔS [mm/sec] | Td [° C.] | Td [K] | A × Td/S$^2$ |
|---|---|---|---|---|---|---|---|---|---|---|---|---|
| K14 | ↑ | ↑ | 250 | 40 | ↑ | ↑ | ↑ | ↑ | ↑ | ↑ | ↑ | ↑ |
| K15 | ↑ | ↑ | 151 | 67 | ↑ | ↑ | ↑ | ↑ | ↑ | ↑ | ↑ | ↑ |
| K16 | ↑ | ↑ | 150 | 68 | ↑ | ↑ | ↑ | ↑ | ↑ | ↑ | ↑ | ↑ |
| K17 | ↑ | ↑ | 219 | 37 | ↑ | ↑ | ↑ | ↑ | ↑ | ↑ | ↑ | ↑ |
| K18 | ↑ | ↑ | 218 | 38 | ↑ | ↑ | ↑ | ↑ | ↑ | ↑ | ↑ | ↑ |
| K19 | ↑ | ↑ | 146 | 68 | ↑ | ↑ | ↑ | ↑ | ↑ | ↑ | ↑ | ↑ |
| K20 | ↑ | ↑ | 243 | 36 | ↑ | ↑ | ↑ | ↑ | ↑ | ↑ | ↑ | ↑ |
| K21 | ↑ | M2 | 172 | 56 | ↑ | ↑ | ↑ | ↑ | ↑ | ↑ | ↑ | ↑ |
| K22 | ↑ | ↑ | 217 | 44 | ↑ | ↑ | ↑ | ↑ | ↑ | ↑ | ↑ | ↑ |
| K23 | ↑ | ↑ | 145 | 63 | ↑ | ↑ | ↑ | ↑ | ↑ | ↑ | ↑ | ↑ |
| K24 | ↑ | ↑ | 152 | 68 | ↑ | ↑ | ↑ | ↑ | ↑ | ↑ | ↑ | ↑ |
| K25 | ↑ | ↑ | 248 | 37 | ↑ | ↑ | ↑ | ↑ | ↑ | ↑ | ↑ | ↑ |
| K26 | ↑ | M3 | 170 | 54 | ↑ | ↑ | ↑ | ↑ | ↑ | ↑ | ↑ | ↑ |
| K27 | ↑ | ↑ | 215 | 45 | ↑ | ↑ | ↑ | ↑ | ↑ | ↑ | ↑ | ↑ |
| K28 | ↑ | ↑ | 227 | 40 | ↑ | ↑ | ↑ | ↑ | ↑ | ↑ | ↑ | ↑ |
| K29 | ↑ | ↑ | 152 | 66 | ↑ | ↑ | ↑ | ↑ | ↑ | ↑ | ↑ | ↑ |
| K30 | ↑ | ↑ | 130 | 68 | ↑ | ↑ | ↑ | ↑ | ↑ | ↑ | ↑ | ↑ |

The result of the endurance by IR6000 remodelled machine is shown in Table 2 below.

TABLE 2

| photosensitive member No. | N/N (40 k) electrical characteristic ΔVd [V] | N/N (40 k) electrical characteristic sensitivity ratio [%] | N/N (40 k) electrical characteristic sensitivity ΔVs1 [V] | N/N (40 k) endurance characteristic streak | N/N (40 k) endurance characteristic flaw | N/N (40 k) endurance characteristic fusion bond | N/N (40 k) endurance characteristic CLN faulty | N/N (40 k) endurance characteristic CLN wear | L/L (30 k) endurance characteristic streak | L/L (30 k) endurance characteristic flaw | L/L (30 k) endurance characteristic fusion bond | L/L (30 k) endurance characteristic CLN faulty | L/L (30 k) endurance characteristic CLN wear | H/H (30 k) endurance characteristic streak | H/H (30 k) endurance characteristic flaw | H/H (30 k) endurance characteristic fusion bond | H/H (30 k) endurance characteristic CLN faulty | H/H (30 k) endurance characteristic CLN wear |
|---|---|---|---|---|---|---|---|---|---|---|---|---|---|---|---|---|---|---|
| K 0 | 10 | 1 | 5 | ◎ | ◎ | ○ | ◎ | ◎ | ◎ | ◎ | ○ | ◎ | ○ | ◎ | ◎ | ○ | ◎ | ◎ |
| K 1 | 11 | 0.5 | 10 | ◎ | ◎ | ○ | ◎ | ◎ | ◎ | ◎ | ○ | ◎ | ○ | ◎ | ◎ | ○ | ◎ | ◎ |
| K 2 | 9 | 2 | 5 | ◎ | ◎ | ○ | ◎ | ◎ | ◎ | ◎ | ○ | ◎ | ○ | ◎ | ◎ | ○ | ◎ | ◎ |
| K 3 | 8 | 4 | 5 | ◎ | ◎ | ○ | ◎ | ◎ | ◎ | ◎ | ○ | ◎ | ○ | ◎ | ◎ | ○ | ◎ | ◎ |
| K 4 | 5 | 3 | 5 | ◎ | ◎ | ○ | ◎ | ◎ | ◎ | ◎ | ○ | ◎ | ○ | ◎ | ◎ | ○ | ◎ | ◎ |
| K 5 | 7 | 2.5 | 10 | ◎ | ◎ | ○ | ◎ | ◎ | ◎ | ◎ | ○ | ◎ | ○ | ◎ | ◎ | ○ | ◎ | ◎ |
| K 6 | 6 | 3 | 15 | ◎ | ◎ | ○ | ◎ | ◎ | ◎ | ◎ | ○ | ◎ | ○ | ◎ | ◎ | ○ | ◎ | ◎ |
| K 7 | 12 | 3.5 | 20 | ◎ | ◎ | ○ | ◎ | ◎ | ◎ | ○ | ○ | ◎ | ○ | ◎ | ◎ | ○ | ◎ | ○ |
| K 8 | 9 | 3.5 | 10 | ◎ | ◎ | ○ | ◎ | ◎ | ◎ | ○ | ○ | ◎ | ○ | ◎ | ○ | ○ | ◎ | ○ |
| K 9 | 8 | 4 | 15 | ◎ | ◎ | ○ | ◎ | ◎ | ◎ | ○ | ○ | ◎ | ○ | ◎ | ○ | ○ | ◎ | ○ |
| K10 | 13 | 4 | 10 | ◎ | ◎ | ○ | ◎ | ◎ | ◎ | ○ | ○ | ◎ | ◎ | ◎ | ○ | ○ | ◎ | ◎ |
| K11 | 11 | 3 | 15 | ○ | ○ | ○ | ○ | ◎ | ○ | ● | ○ | ○ | ○ | ○ | X | ○ | ○ | ○ |
| K12 | 10 | 2 | 15 | ○ | ○ | ○ | ○ | ◎ | ○ | ● | ○ | ○ | ○ | ○ | X | ○ | ○ | ○ |
| K13 | 5 | 2 | 20 | ○ | ● | ○ | ○ | ● | ○ | ● | ○ | ○ | ● | ○ | X | ○ | ○ | ● |
| K14 | 7 | 3.5 | 15 | ○ | ● | ○ | ○ | ● | ○ | ● | ○ | ○ | ● | ○ | X | ○ | ○ | ● |
| K15 | 6 | 1 | 10 | ○ | ○ | ○ | ◎ | ○ | ○ | ● | ○ | ◎ | ○ | ○ | X | ○ | ◎ | ○ |
| K16 | 5 | 0.5 | 15 | ○ | ○ | ○ | ◎ | ○ | ○ | ● | ○ | ◎ | ○ | ○ | X | ○ | ◎ | ○ |
| K17 | 14 | 4 | 10 | ○ | ● | ○ | ◎ | ● | ○ | ● | ○ | ◎ | ● | ○ | X | ○ | ◎ | ● |
| K18 | 13 | 4 | 10 | ○ | ● | ○ | ◎ | ● | ○ | ● | ○ | ◎ | ● | ○ | X | ○ | ◎ | ● |
| K19 | 10 | 1 | 15 | ○ | ○ | ○ | ○ | ○ | ○ | ● | ○ | ○ | ○ | ○ | X | ○ | ○ | ○ |
| K20 | 14 | 4.5 | 10 | ○ | ● | ○ | ○ | ● | ○ | ● | ○ | ○ | ● | ○ | X | ○ | ○ | ● |
| K21 | 13 | 1 | 15 | ◎ | ◎ | ○ | ◎ | ◎ | ◎ | ○ | ○ | ◎ | ○ | ◎ | ○ | ○ | ◎ | ○ |
| K22 | 12 | 3.5 | 10 | ◎ | ◎ | ○ | ◎ | ◎ | ◎ | ○ | ○ | ◎ | ○ | ◎ | ○ | ○ | ◎ | ○ |
| K23 | 9 | 0.5 | 15 | ○ | ○ | ○ | ◎ | ○ | ○ | ● | ○ | ◎ | ○ | ○ | X | ○ | ◎ | ○ |
| K24 | 8 | 1 | 15 | ○ | ○ | ○ | ◎ | ○ | ○ | ● | ○ | ◎ | ○ | ○ | X | ○ | ◎ | ○ |
| K25 | 13 | 3 | 20 | ○ | ● | ○ | ○ | ● | ○ | ● | ○ | ○ | ● | ○ | X | ○ | ○ | ● |
| K26 | 10 | 2.5 | 10 | ◎ | ◎ | ○ | ◎ | ◎ | ◎ | ◎ | ○ | ◎ | ○ | ◎ | ◎ | ○ | ◎ | ○ |
| K27 | 11 | 3 | 10 | ◎ | ◎ | ○ | ◎ | ◎ | ◎ | ○ | ○ | ◎ | ○ | ◎ | ◎ | ○ | ◎ | ○ |
| K28 | 13 | 3 | 5 | ○ | ● | ○ | ◎ | ● | ○ | ● | ○ | ○ | ● | ○ | X | ○ | ◎ | ● |
| K29 | 9 | 1.5 | 1 | ○ | ○ | ○ | ◎ | ○ | ○ | ● | ○ | ○ | ○ | ○ | X | ○ | ◎ | ○ |
| K30 | 8 | 1 | 20 | ○ | ○ | ○ | ○ | ○ | ○ | ● | ○ | ○ | ○ | ○ | X | ○ | ○ | ○ |

(CLN is the abbreviation of cleaning.)

From Table 1 and Table 2, it will be seen that the photosensitive member K1 (HU=150 [N/mm$^2$], We=65[%]) to the photosensitive member K10 (HU=220 [N/mm$^2$], We=40[%]) exhibit good results even by the endurance test, but in the photosensitive member K11 (HU=148 [N/mm$^2$], We=64[%]), the photosensitive member K23 (HU=145 [N/mm$^2$], We=63[%]), the photosensitive member K29 (HU=152 [N/mm$^2$], We=66[%]), etc., flaws particularly under H/H environment occur to a degree which cannot be neglected in respect of size and number.

Also, the photosensitive member K10 (HU=220 [N/mm$^2$], We=40[%]) exhibits a good characteristic even by the endurance test, but in the photosensitive member K13 (HU=223 [N/mm$^2$], We=41[%]), flaws particularly under H/H environment occur to a degree which cannot be neglected in respect of size and number.

Accordingly, it has been found from the foregoing result that in the photosensitive member, the preferable range of the universal hardness value HU is 150 or greater and 220 or less [N/mm$^2$] and the preferable range of We is 40 or greater and 65 or less [%].

In these photosensitive members having the hardened type surface layer, both of the characteristic of the photosensitive member and the image are good, and the abrasion amount in endurance is small and even in the endurance, little or no change is seen in the characteristic of the photosensitive member, and a very stable and good characteristic is exhibited. Also, as regards the abrasion resistance, the abrasion amount is much reduced, and the abrasion amount after 100K endurance is 5 μm or less, and localized abrasion or the like is absent, and very good durability was exhibited.

On the other hand, in the case outside the above-noted range, flaw and abrasion and a reduction in the durability of the cleaning member sometimes occurred.

[Second Embodiment]

By the use of the photosensitive member K0 and the evaluating apparatus used in the first embodiment, and by the use of DR2–DR10 besides the elastic member DR1, the value of A×Td/S$^2$ was allotted, or by the use of the fur brushes F1–F10, the value of B×Td/S$^2$ was allotted, and under the same conditions as those in the first embodiment, a wear resistance test and evaluation were carried out at N/N, N/L and H/H. In the foregoing, A=ΔS×Ps, and B=ΔS×Df$^2$.

The evaluating conditions are shown in Table 3 below, and the result of the wear resistance evaluation by IR6000 remodelled machine is shown in Table 4 below.

TABLE 3

| Embodiment 2 | speed S | auxiliary | elastic member hardness | elastic member abutting pressure PS | driving relative speed | ΔS | fur Df | Td | | A × Td/S$^2$ | B × Td/S$^2$ |
|---|---|---|---|---|---|---|---|---|---|---|---|
| Test No. | [mm/sec] | member | [degree] | [gf/cm] | [%] | [mm/sec] | [tex] | [° C.] | [K] | | |
| J2-01 | 265 | DR1 | 20 | 10 | −25% | 331.3 | | 40 | 313.15 | 1.477E+01 | |
| J2-02 | ↑ | DR2 | 5 | 10 | −50% | 397.5 | | ↑ | ↑ | 1.773E+01 | |
| J2-03 | ↑ | DR3 | 7 | 20 | 55% | 119.3 | | ↑ | ↑ | 1.064E+01 | |
| J2-04 | ↑ | DR4 | 15 | 23 | 25% | 198.8 | | ↑ | ↑ | 2.039E+01 | |
| J2-05 | ↑ | DR5 | 28 | 28 | −25% | 331.3 | | ↑ | ↑ | 4.137E+01 | |
| J2-06 | ↑ | DR6 | 30 | 32 | −150% | 662.5 | | ↑ | ↑ | 9.454E+01 | |
| J2-07 | ↑ | DR7 | 33 | 38 | 20% | 212 | | ↑ | ↑ | 3.592E+01 | |
| J2-08 | ↑ | DR8 | 50 | 43 | −150% | 662.5 | | ↑ | ↑ | 1.270E+02 | |
| J2-09 | ↑ | DR5 | 28 | 4 | −25% | 331.3 | | ↑ | ↑ | 5.909E+00 | |
| J2-10 | ↑ | ↑ | 28 | 8 | 70% | 79.5 | | ↑ | ↑ | 2.836E+00 | |
| J2-11 | ↑ | ↑ | 28 | 53 | 20% | 212 | | ↑ | ↑ | 5.010E+01 | |
| J2-12 | ↑ | ↑ | 28 | 65 | 150% | 132.5 | | 45 | 318.15 | 3.902E+01 | |
| J2-13 | ↑ | F1 | | | 150% | 132.5 | 2.22 | 40 | 313.15 | | 2.912E+00 |
| J2-14 | ↑ | ↑ | | | 90% | 26.5 | ↑ | ↑ | ↑ | | 5.824E−01 |
| J2-15 | ↑ | ↑ | | | 50% | 132.5 | ↑ | ↑ | ↑ | | 2.912E+00 |
| J2-16 | ↑ | ↑ | | | 10% | 238.5 | ↑ | ↑ | ↑ | | 5.241E+00 |
| J2-17 | ↑ | ↑ | | | −10% | 291.5 | ↑ | ↑ | ↑ | | 6.406E+00 |
| J2-18 | ↑ | ↑ | | | −30% | 344.5 | ↑ | ↑ | ↑ | | 7.571E+00 |
| J2-19 | ↑ | ↑ | | | −50% | 397.5 | ↑ | ↑ | ↑ | | 8.736E+00 |
| J2-20 | ↑ | ↑ | | | 0% | 265 | ↑ | ↑ | ↑ | | 5.824E+00 |
| J2-21 | ↑ | ↑ | | | 100% | 0 | ↑ | ↑ | ↑ | | 0.000E+00 |
| J2-22 | ↑ | F2 | | | 70% | 79.5 | 0.56 | ↑ | ↑ | | 1.112E−01 |
| J2-23 | ↑ | F3 | | | ↑ | ↑ | ↑ | ↑ | ↑ | | 1.112E−01 |
| J2-24 | ↑ | F4 | | | ↑ | ↑ | ↑ | ↑ | ↑ | | 1.112E−01 |
| J2-25 | ↑ | F5 | | | ↑ | ↑ | 1.23 | ↑ | ↑ | | 5.363E−01 |
| J2-26 | ↑ | F6 | | | ↑ | ↑ | 2.01 | ↑ | ↑ | | 1.432E+00 |
| J2-27 | ↑ | F7 | | | ↑ | ↑ | 3.15 | ↑ | ↑ | | 3.518E−00 |
| J2-28 | ↑ | F8 | | | ↑ | ↑ | 3.33 | ↑ | ↑ | | 3.931E+00 |
| J2-29 | ↑ | F9 | | | ↑ | ↑ | 3.45 | ↑ | ↑ | | 4.220E+00 |
| J2-30 | ↑ | F10 | | | ↑ | ↑ | 5.67 | ↑ | ↑ | | 1.140E+01 |

TABLE 4

| Embodiment 2 Test No. | abrasion of photosensitive member: abrasion rate [$10^{-6}$ μm/rot] | abrasion evaluation of abrasion | N/N (40 k) electrical characteristic: ΔVd [V] | sensitivity ratio[%] | ΔVs1 [V] | N/N (40 k) endurance characteristic: streak | flaw | fusion bond | CLN faulty | CLN wear |
|---|---|---|---|---|---|---|---|---|---|---|
| J2-01 | 25.8 | ○ | 10 | 1.5 | 5 | ○ | ◎ | ○ | ◎ | ◎ |
| J2-02 | 25 | ○ | 10 | 2 | 5 | ◎ | ◎ | ○ | ◎ | ◎ |
| J2-03 | 23.3 | ○ | 15 | 1.5 | 10 | ◎ | ◎ | ○ | ◎ | ◎ |
| J2-04 | 24.5 | ○ | 10 | 1 | 15 | ◎ | ◎ | ○ | ◎ | ○ |
| J2-05 | 35.8 | ○ | 15 | 1 | 10 | ◎ | ◎ | ○ | ◎ | ◎ |
| J2-06 | 39.5 | ○ | 15 | 1.5 | 20 | ◎ | ◎ | ○ | ◎ | ◎ |
| J2-07 | 42.5 | ● | 10 | 2.5 | 15 | ◎ | ○ | ○ | ◎ | ◎ |
| J2-08 | 48.9 | ● | 15 | 2 | 10 | ◎ | ○ | ○ | ◎ | ◎ |
| J2-09 | 38.5 | ○ | 20 | 1 | 15 | ◎ | ◎ | ○ | ◎ | ◎ |
| J2-10 | 32.5 | ○ | 15 | 1.5 | 5 | ◎ | ◎ | ○ | ◎ | ◎ |
| J2-11 | 48.2 | ○ | 15 | 1.5 | 10 | ◎ | ○ | ○ | ◎ | ◎ |
| J2-12 | 48.9 | ○ | 10 | 1 | 5 | ◎ | ○ | ○ | ◎ | ◎ |
| J2-13 | 20.3 | ○ | 5 | 1 | 5 | ◎ | ◎ | ◎ | ◎ | ◎ |
| J2-14 | 25.8 | ○ | 5 | 0.5 | 5 | ◎ | ◎ | ◎ | ◎ | ◎ |
| J2-15 | 38.7 | ○ | 10 | 1.5 | 10 | ◎ | ◎ | ◎ | ◎ | ◎ |
| J2-16 | 38.7 | ○ | 15 | 1.5 | 15 | ◎ | ◎ | ◎ | ◎ | ◎ |
| J2-17 | 38.7 | ○ | 10 | 1 | 10 | ◎ | ◎ | ◎ | ◎ | ◎ |
| J2-18 | 38.7 | ○ | 15 | 2 | 5 | ◎ | ◎ | ◎ | ◎ | ◎ |
| J2-19 | 38.7 | ○ | 20 | 1.5 | 5 | ◎ | ◎ | ◎ | ◎ | ◎ |
| J2-20 | 38.7 | ○ | 10 | 1 | 10 | ○ | ◎ | ◎ | ○ | ○ |
| J2-21 | 38.7 | ○ | 15 | 2 | 15 | ○ | ◎ | ◎ | ○ | ◎ |
| J2-22 | 28.6 | ○ | 15 | 1.5 | 20 | ◎ | ◎ | ◎ | ○ | ◎ |
| J2-23 | 30.2 | ○ | 10 | 2 | 20 | ◎ | ◎ | ◎ | ○ | ◎ |
| J2-24 | 32.1 | ○ | 15 | 1.5 | 15 | ◎ | ◎ | ◎ | ◎ | ◎ |
| J2-25 | 35.6 | ○ | 15 | 1 | 10 | ◎ | ◎ | ◎ | ◎ | ◎ |
| J2-26 | 38.0 | ○ | 15 | 1 | 5 | ◎ | ◎ | ◎ | ◎ | ◎ |
| J2-27 | 38.2 | ○ | 10 | 1.5 | 5 | ◎ | ◎ | ◎ | ◎ | ◎ |
| J2-28 | 38.9 | ○ | 15 | 1 | 10 | ◎ | ◎ | ◎ | ◎ | ◎ |
| J2-29 | 42.6 | ● | 10 | 1 | 15 | ◎ | ○ | ◎ | ◎ | ◎ |
| J2-30 | 45.8 | ● | 15 | 2 | 5 | ◎ | ○ | ◎ | ◎ | ◎ |

| Embodiment 2 Test No. | L/L (30 k) endurance characteristic: streak | flaw | fusion bond | CLN faulty | CLN wear | H/H (30 k) endurance characteristic: streak | flaw | fusion bond | CLN faulty | CLN wear |
|---|---|---|---|---|---|---|---|---|---|---|
| J2-01 | ○ | ◎ | ○ | ◎ | ○ | ● | ◎ | ○ | ◎ | ○ |
| J2-02 | ◎ | ◎ | ○ | ◎ | ○ | ◎ | ◎ | ○ | ◎ | ○ |
| J2-03 | ◎ | ◎ | ○ | ◎ | ○ | ◎ | ◎ | ○ | ◎ | ○ |
| J2-04 | ◎ | ◎ | ○ | ◎ | ○ | ◎ | ◎ | ○ | ◎ | ○ |
| J2-05 | ◎ | ◎ | ○ | ◎ | ○ | ◎ | ◎ | ○ | ◎ | ○ |
| J2-06 | ◎ | ◎ | ○ | ◎ | ○ | ◎ | ◎ | ○ | ◎ | ○ |
| J2-07 | ◎ | ○ | ○ | ◎ | ○ | ◎ | ● | ○ | ◎ | ○ |
| J2-08 | ◎ | ● | ○ | ◎ | ○ | ◎ | ● | ● | ◎ | ○ |
| J2-09 | ○ | ◎ | ○ | ◎ | ○ | ● | ◎ | ○ | ◎ | ○ |
| J2-10 | ○ | ◎ | ○ | ◎ | ○ | ● | ◎ | ○ | ◎ | ○ |
| J2-11 | ◎ | ○ | ○ | ◎ | ○ | ◎ | ● | ○ | ◎ | ○ |
| J2-12 | ◎ | ○ | ○ | ◎ | ○ | ◎ | ● | ○ | ◎ | ○ |
| J2-13 | ◎ | ◎ | ◎ | ◎ | ◎ | ◎ | ◎ | ◎ | ◎ | ○ |
| J2-14 | ◎ | ◎ | ◎ | ◎ | ◎ | ◎ | ◎ | ◎ | ◎ | ○ |
| J2-15 | ◎ | ◎ | ◎ | ◎ | ◎ | ◎ | ◎ | ◎ | ◎ | ○ |
| J2-16 | ◎ | ◎ | ◎ | ◎ | ◎ | ◎ | ◎ | ◎ | ◎ | ○ |
| J2-17 | ◎ | ◎ | ◎ | ◎ | ◎ | ◎ | ◎ | ◎ | ◎ | ○ |
| J2-18 | ◎ | ◎ | ◎ | ◎ | ◎ | ◎ | ◎ | ◎ | ◎ | ○ |
| J2-19 | ◎ | ◎ | ◎ | ◎ | ◎ | ◎ | ◎ | ◎ | ◎ | ○ |
| J2-20 | ● | ○ | ◎ | ○ | ● | ● | ● | ◎ | ● | ● |
| J2-21 | ● | ◎ | ◎ | ○ | ◎ | ● | ◎ | ◎ | ● | ◎ |
| J2-22 | ◎ | ◎ | ◎ | ○ | ◎ | ◎ | ◎ | ◎ | ● | ◎ |
| J2-23 | ◎ | ◎ | ◎ | ○ | ◎ | ◎ | ◎ | ◎ | ● | ◎ |
| J2-24 | ◎ | ◎ | ◎ | ◎ | ◎ | ◎ | ◎ | ◎ | ◎ | ◎ |
| J2-25 | ◎ | ◎ | ◎ | ◎ | ◎ | ◎ | ◎ | ◎ | ◎ | ◎ |
| J2-26 | ◎ | ◎ | ◎ | ◎ | ◎ | ◎ | ◎ | ◎ | ◎ | ◎ |
| J2-27 | ◎ | ◎ | ◎ | ◎ | ◎ | ◎ | ◎ | ◎ | ◎ | ◎ |
| J2-28 | ◎ | ◎ | ◎ | ◎ | ◎ | ◎ | ◎ | ◎ | ◎ | ◎ |

TABLE 4-continued

| | | | | | | | | | | |
|---|---|---|---|---|---|---|---|---|---|---|
| J2-29 | ◎ | ● | ◎ | ◎ | ◎ | ◎ | ● | ◎ | ◎ | ◎ |
| J2-30 | ○ | ● | ◎ | ◎ | ◎ | ○ | ● | ◎ | ◎ | ◎ |

From Table 3 and Table 4, it will be seen that as regards the rubbing step by the elastic member and the fur brush, a good result was obtained when they were driven at a relative speed of −150 through +150% to the photosensitive member. In any of the rubbing members, however, in the case of stop (0%), the unevenness of the rub particularly in longitudinal direction occurred, and in the case of the accompanying rotation (+100%), the rubbing effect is reduced and a reduction in the quality of image was seen. As the driving speed of the rubbing member, the above-mentioned −150 through +150% excluding the ranges of 0±5% and +100±5% is more preferable.

Also, as the hardness of the elastic member, a range of 5–30° in terms of Asker-C hardness is preferable. In the case of a hard elastic member exceeding 30°, the wear of the photosensitive member may sometimes occur. Also, in the case of an elastic member of low hardness less than 5°, the abutting pressure of the elastic member becomes low and the rubbing effect is reduced or the elastic member is damaged or the outer diameter thereof is changed and thus, there has been a case where the elastic member does not stand the above-described endurance.

On the other hand, as regards the fur brush, a good result was obtained in the case of a fur brush of 0.56–3.33 tex (5D–30D). In the case of a fur brush of less than 0.56 tex, the fur was worn out or deformed and the rubbing effect was insufficient. Also, when 0.33 tex was exceeded, the wear of the photosensitive member sometimes occurred.

In the present embodiment, a good result was obtained when $A \times Td/S^2$ was within the range of $1E0 \leqq A \times Td/S^2 \leqq 5E2$ ($A = \Delta S \times Ps$), and more preferably the range of $2.840 \leqq A \times Td/S^2 \leqq 127$, and when $B \times Td/S^2$ was within the range of $1E-1 \leqq B \times Td/S^2 \leqq 1E2$ ($B = \Delta S \times Df^2$) and more preferably the range of $0.11 \leqq B \times Td/S^2 \leqq 11.4$.

Also, when a study was made with Tg of the toner allotted by wax contained in toner particles, a good result was obtained at Tg=40–90° C., and preferably at Tg=50–70° C. Outside the foregoing range, an inconvenience sometimes occurred to the fixing property and besides, fusion bond became liable to occur particularly on the low Tg side.

[Third Embodiment]

By the use of the photosensitive member K0 and the evaluating apparatus used in the first embodiment, a wear resistance test and evaluation were carried out at N/N, N/L and H/H under conditions similar to those in the first embodiment with the exception that the temperature Td of this photosensitive member K0 was controlled to 30 to 55° C. by the use of the above-described heater.

The evaluating conditions are shown in Table 5 below.

TABLE 5

| Embodiment 3 Test No. | photosensitive member No. | surface layer: charge transporting function | surface layer: charge transport material | HU [N/mm²] | We [%] | speed S [mm/sec] |
|---|---|---|---|---|---|---|
| J3-01 | K0 | M1 | without | 180 | 48 | 265 |
| J3-02 | | | | | | |
| J3-03 | | | | | | |
| J3-04 | | | | | | |
| J3-05 | | | | | | |
| J3-06 | | | | | | |
| J3-07 | | | | | | |
| J3-08 | | | | | | |
| J3-09 | | | | | | |

| Embodiment 3 Test No. | auxiliary member | abutting pressure PS [gf/cm] | driving speed [%] | ΔS [mm/sec] | Td [° C./K] | A × Td/S² |
|---|---|---|---|---|---|---|
| J3-01 | DR1 | 30 | 70% | 79.5 | 30 303.15 | 1.030E+01 |
| J3-02 | | | | | 33 306.15 | 1.040E+01 |
| J3-03 | | | | | 35 308.15 | 1.047E+01 |
| J3-04 | | | | | 37 310.15 | 1.053E+01 |
| J3-05 | | | | | 40 313.15 | 1.064E+01 |
| J3-06 | | | | | 43 316.15 | 1.074E+01 |
| J3-07 | | | | | 50 323.15 | 1.097E+01 |
| J3-08 | | | | | 52 325.15 | 1.104E+01 |
| J3-09 | | | | | 55 328.15 | 1.114E+01 |

TABLE 6

| Embodiment 3 Test No. | abrasion of photosensitive member: abrasion rate [$10^{-6}$ μm/rot] | abrasion of photosensitive member: evaluation of abrasion | N/N (40 k) electrical characteristic: ΔVd [V] | ΔVd: sensitivity ratio[%] | ΔVs1 [V] | N/N (40 k) endurance characteristic: streak | flaw | fusion bond | CLN faulty | CLN wear |
|---|---|---|---|---|---|---|---|---|---|---|
| J3-01 | 39.4 | ○ | 20 | 2 | 20 | ○ | ◎ | ○ | ◎ | ◎ |
| J3-02 | 38.7 | ○ | 15 | 2.5 | 15 | ○ | ◎ | ○ | ◎ | ◎ |
| J3-03 | 37.6 | ○ | 10 | 1.5 | 10 | ◎ | ◎ | ○ | ◎ | ◎ |
| J3-04 | 37.5 | ○ | 11 | 1 | 10 | ◎ | ◎ | ○ | ◎ | ◎ |
| J3-05 | 36.8 | ○ | 10 | 1 | 5 | ◎ | ◎ | ○ | ◎ | ◎ |
| J3-06 | 37.8 | ○ | 10 | 1.5 | 5 | ◎ | ◎ | ○ | ◎ | ◎ |
| J3-07 | 38.7 | ○ | 10 | 1 | 10 | ◎ | ◎ | ○ | ◎ | ◎ |
| J3-08 | 36.5 | ○ | 5 | 1.5 | 10 | ◎ | ◎ | ○ | ◎ | ◎ |
| J3-09 | 38.5 | ○ | 10 | 1 | 5 | ◎ | ◎ | ● | ◎ | ◎ |

| Embodiment 3 Test No. | L/L (30 k) endurance characteristic: streak | flaw | fusion bond | CLN faulty | CLN wear | H/H (30 k) endurance characteristic: streak | flaw | fusion bond | CLN faulty | CLN wear |
|---|---|---|---|---|---|---|---|---|---|---|
| J3-01 | ○ | ◎ | ○ | ○ | ○ | ● | ◎ | ○ | ○ | ● |
| J3-02 | ○ | ◎ | ○ | ◎ | ◎ | ● | ◎ | ○ | ◎ | ◎ |
| J3-03 | ◎ | ◎ | ○ | ◎ | ◎ | ○ | ◎ | ○ | ◎ | ◎ |
| J3-04 | ◎ | ◎ | ○ | ◎ | ◎ | ◎ | ◎ | ○ | ◎ | ◎ |
| J3-05 | ◎ | ◎ | ○ | ◎ | ○ | ◎ | ◎ | ○ | ◎ | ◎ |
| J3-06 | ◎ | ◎ | ○ | ◎ | ○ | ◎ | ◎ | ○ | ◎ | ◎ |
| J3-07 | ◎ | ◎ | ○ | ◎ | ○ | ◎ | ◎ | ○ | ◎ | ◎ |
| J3-08 | ◎ | ◎ | ○ | ○ | ○ | ◎ | ◎ | ● | ○ | ○ |
| J3-09 | ◎ | ◎ | ● | ○ | ○ | ◎ | ◎ | ● | ○ | ○ |

From Table 5 and Table 6, it will be seen that as the surface temperature Td of the photosensitive member, 308.15K or greater and 322.15K or less, i.e., 35° C. or greater and 50° C. or less is a suitable condition. At a low temperature, there is a case where the suppression of the streak-like defect is deficient, while on the other hand, if Td was too high a temperature, there was a case where such a problem as the fusion bond of the developer occurred.

Further, a wear resistance test of 40K was carried out with the temperature Td of the photosensitive member allotted under N/N environment. Likewise, a wear resistance test of 40K was also carried out with the temperature Td of the photosensitive member allotted under each of L/L and H/H environments. As a result, a good result was obtained particularly against a streak-like defect when Td was made higher by 3 deg or more than each environmental temperature before the image forming process. Above all, within the above-mentioned range of 35° C. or greater and 50° C. or less, a particularly good result was obtained.

[Fourth Embodiment]

By the use of the photosensitive member K0 and the evaluating apparatus used in the first embodiment, the driving condition of the elastic rollers DR1-13 was allotted and, as in the first embodiment, a wear resistance test and evaluation were carried out at N/N, N/L and H/H.

The evaluating conditions are shown in Table 7 below.

TABLE 7

| Embodiment 4 Test No. | speed S [mm/sec] | auxiliary member: kind | hardness [°] | abutting pressure PS [gf/cm] | driving speed [%] | ΔS [mm/sec] | Td [° C./K] | | A × Td/$S^2$ |
|---|---|---|---|---|---|---|---|---|---|
| J4-01 | 350 | DR1 | 5 | 5 | 90% | 35 | 35 | 308.15 | 4.402E−01 |
| J4-02 | 210 | DR2 | 20 | 5 | 95% | 10.5 | 35 | 308.15 | 3.668E−01 |
| J4-03 | 265 | DR2 | 5 | 15 | 70% | 79.5 | 35 | 308.15 | 5.233E+00 |
| J4-04 | 265 | DR3 | 7 | 30 | 50% | 132.5 | 40 | 313.15 | 1.773E+01 |
| J4-05 | 265 | DR4 | 15 | 50 | 30% | 185.5 | 40 | 313.15 | 4.136E+01 |
| J4-06 | 265 | DR5 | 28 | 40 | −30% | 344.5 | 40 | 313.15 | 6.145E+01 |

TABLE 7-continued

| Embodiment 4 Test No. | speed S [mm/sec] | auxiliary member kind | hardness [°] | abutting pressure PS [gf/cm] | driving speed [%] | ΔS [mm/sec] | Td [° C./K] | | A × Td/S$^2$ |
|---|---|---|---|---|---|---|---|---|---|
| J4-07 | 265 | DR6 | 30 | 45 | −85% | 490.3 | 45 | 318.15 | 9.996E+01 |
| J4-08 | 265 | DR9 | 15 | 45 | −150% | 662.5 | 50 | 323.15 | 1.372E+02 |
| J4-09 | 150 | DR10 | 28 | 48 | −150% | 375 | 50 | 323.15 | 2.585E+02 |
| J4-10 | 100 | DR11 | 25 | 60 | −130% | 230 | 50 | 323.15 | 4.459E+02 |
| J4-11 | 100 | DR12 | 28 | 65 | −130% | 230 | 50 | 323.15 | 4.831E+02 |
| J4-12 | 100 | DR12 | 28 | 65 | −135% | 235 | 50 | 323.15 | 4.936E+02 |
| J4-13 | 100 | DR13 | 28 | 65 | −150% | 250 | 45 | 318.15 | 5.170E+02 |

The result of the endurance by IR6000 remodelled machine is shown in Table 8 below.

TABLE 8

| Embodiment 4 Test No. | abrasion of photosensitive member: abrasion rate [$10^5$ μm/rot] | abrasion of photosensitive member: evaluation of abrasion | N/N (40 k) electrical characteristic: ΔVd [V] | sensitivity ratio[%] | ΔVs1 [V] | N/N (40 k) endurance characteristic: streak | flaw | fusion bond | CLN faulty | CLN wear |
|---|---|---|---|---|---|---|---|---|---|---|
| J4-01 | 26.5 | ○ | 10 | 1 | 5 | ◎ | ◎ | ○ | ◎ | ◎ |
| J4-02 | 25.1 | ○ | 5 | 1.5 | 5 | ◎ | ◎ | ○ | ◎ | ◎ |
| J4-03 | 28.5 | ○ | 15 | 1.5 | 5 | ◎ | ◎ | ○ | ◎ | ◎ |
| J4-04 | 32.5 | ○ | 20 | 2 | 5 | ◎ | ◎ | ○ | ◎ | ◎ |
| J4-05 | 33.6 | ○ | 10 | 2 | 5 | ◎ | ◎ | ○ | ◎ | ◎ |
| J4-06 | 35.1 | ○ | 10 | 1.5 | 5 | ◎ | ◎ | ○ | ◎ | ◎ |
| J4-07 | 36 | ○ | 5 | 0.5 | 5 | ◎ | ◎ | ○ | ◎ | ◎ |
| J4-08 | 37.9 | ○ | 15 | 1 | 5 | ◎ | ◎ | ○ | ◎ | ◎ |
| J4-09 | 38.8 | ○ | 5 | 1.5 | 5 | ◎ | ◎ | ○ | ◎ | ◎ |
| J4-10 | 38.9 | ○ | 10 | 1 | 5 | ◎ | ◎ | ○ | ◎ | ◎ |
| J4-11 | 39.2 | ○ | 15 | 1.5 | 5 | ◎ | ◎ | ○ | ◎ | ◎ |
| J4-12 | 40.6 | ● | 10 | 1 | 5 | ◎ | ○ | ○ | ◎ | ◎ |
| J4-13 | 52.2 | X | 10 | 2 | 5 | ◎ | ○ | ○ | ◎ | ◎ |

| Embodiment 4 Test No. | L/L (30 k) endurance characteristic: streak | flaw | fusion bond | CLN faulty | CLN wear | H/H (30 k) endurance characteristic: streak | flaw | fusion bond | CLN faulty | CLN wear |
|---|---|---|---|---|---|---|---|---|---|---|
| J4-01 | ○ | ◎ | ○ | ◎ | ○ | ● | ◎ | ● | ○ | ○ |
| J4-02 | ○ | ◎ | ○ | ◎ | ○ | ● | ◎ | ● | ○ | ○ |
| J4-03 | ◎ | ◎ | ○ | ◎ | ○ | ◎ | ◎ | ○ | ◎ | ◎ |
| J4-04 | ◎ | ◎ | ○ | ◎ | ○ | ◎ | ◎ | ○ | ◎ | ◎ |
| J4-05 | ◎ | ◎ | ○ | ◎ | ○ | ◎ | ◎ | ○ | ◎ | ◎ |
| J4-06 | ◎ | ◎ | ○ | ◎ | ○ | ◎ | ◎ | ○ | ◎ | ◎ |
| J4-07 | ◎ | ◎ | ○ | ◎ | ○ | ◎ | ◎ | ○ | ◎ | ◎ |
| J4-08 | ◎ | ◎ | ○ | ◎ | ○ | ◎ | ◎ | ○ | ◎ | ◎ |
| J4-09 | ◎ | ◎ | ○ | ◎ | ○ | ◎ | ◎ | ○ | ◎ | ◎ |
| J4-10 | ◎ | ◎ | ○ | ◎ | ○ | ◎ | ◎ | ○ | ◎ | ◎ |
| J4-11 | ◎ | ◎ | ○ | ◎ | ○ | ◎ | ◎ | ○ | ◎ | ◎ |
| J4-12 | ◎ | ◎ | ○ | ◎ | ○ | ◎ | ○ | ○ | ◎ | ◎ |
| J4-13 | ◎ | ◎ | ● | ◎ | ○ | ◎ | ● | ○ | ○ | ◎ |

From Table 7 and Table 8, it will be seen that a good result was obtained within the range of $1E0 \leqq A \times Td/S^2 \leqq 5E2$ ($A=\Delta S \times Ps$), and preferably within the range of $5.233 \leqq A\Delta Td/S^2 \leqq 493.6$.

[Fifth Embodiment]

By the use of the photosensitive member K0 and the evaluating apparatus used in the first embodiment, and by the use of the above-described heater, the temperature Td of the photosensitive member K0 was controlled to 30 to 55° C., and by the use of the fur brush, evaluation similar to that in the fourth embodiment was carried out. The evaluating conditions are shown in Table 9 below.

TABLE 9

| Embodiment 5 Test No. | speed S [mm/sec] | auxiliary member | driving speed [%] | ΔS [mm/sec] | Df [tex] | Td [° C.] | Td [K] | B × Td/S² |
|---|---|---|---|---|---|---|---|---|
| J5-01 | 265 | F1 | 90% | 26.5 | 2.22 | 40 | 313.15 | 5.824E−01 |
| J5-02 | 265 | F1 | 90% | 26.5 | 2.22 | 40 | 313.15 | 5.824E−01 |
| J5-03 | 265 | F1 | 50% | 132.5 | 2.22 | 40 | 313.15 | 2.912E+00 |
| J5-04 | 265 | F1 | 10% | 238.5 | 2.22 | 40 | 313.15 | 5.241E+00 |
| J5-05 | 265 | F1 | −10% | 291.5 | 2.22 | 40 | 313.15 | 6.406E+00 |
| J5-06 | 265 | F1 | −30% | 344.5 | 2.22 | 40 | 313.15 | 7.571E+00 |
| J5-07 | 265 | F1 | −50% | 397.5 | 2.22 | 40 | 313.15 | 8.736E+00 |
| J5-08 | 265 | F1 | 0% | 265 | 2.22 | 40 | 313.15 | 5.824E+00 |
| J5-09 | 265 | F1 | 100% | 0 | 2.22 | 40 | 313.15 | 0.000E+00 |
| J5-10 | 350 | F2 | 90% | 35 | 0.56 | 40 | 313.15 | 2.806E−02 |
| J5-11 | 200 | F3 | 80% | 40 | 0.56 | 35 | 308.15 | 9.664E−02 |
| J5-12 | 265 | F4 | 70% | 79.5 | 0.56 | 40 | 313.15 | 1.112E−01 |
| J5-13 | 265 | F5 | 70% | 79.5 | 1.23 | 40 | 313.15 | 5.363E−01 |
| J5-14 | 265 | F6 | 70% | 79.5 | 2.01 | 40 | 313.15 | 1.432E+00 |
| J5-15 | 265 | F7 | 70% | 79.5 | 3.15 | 40 | 313.15 | 3.518E+00 |
| J5-16 | 350 | F8 | 70% | 105 | 3.33 | 40 | 313.15 | 2.976E+00 |
| J5-17 | 80 | F11 | −120% | 176 | 3.32 | 50 | 323.15 | 9.795E+01 |
| J5-18 | 80 | F12 | −150% | 200 | 3.33 | 50 | 323.15 | 1.120E+02 |

Also, the result of the endurance by IR6000 remodelled machine is shown in Table 10 below.

TABLE 10

| Embodiment 5 Test No. | abrasion of photosensitive member: abrasion rate [10⁶ μm/rot] | abrasion of photosensitive member: evaluation of abrasion | N/N (40 k) electrical characteristic: ΔVd [V] | sensitivity ratio[%] | ΔVs1 [V] | endurance characteristic: streak | flaw | fusion bond | CLN faulty | CLN wear |
|---|---|---|---|---|---|---|---|---|---|---|
| J5-01 | 20.3 | ○ | 5 | 1 | 5 | ◎ | ◎ | ◎ | ◎ | ◎ |
| J5-02 | 25.8 | ○ | 5 | 0.5 | 5 | ◎ | ◎ | ◎ | ◎ | ◎ |
| J5-03 | 38.7 | ○ | 10 | 1.5 | 10 | ◎ | ◎ | ◎ | ◎ | ◎ |
| J5-04 | 38.7 | ○ | 15 | 1.5 | 15 | ◎ | ◎ | ◎ | ◎ | ◎ |
| J5-05 | 38.7 | ○ | 10 | 1 | 10 | ◎ | ◎ | ◎ | ◎ | ◎ |
| J5-06 | 38.7 | ○ | 15 | 2 | 5 | ◎ | ◎ | ◎ | ◎ | ◎ |
| J5-07 | 38.7 | ○ | 20 | 1.5 | 5 | ◎ | ◎ | ◎ | ◎ | ◎ |
| J5-08 | 38.7 | ○ | 10 | 1 | 10 | ○ | ◎ | ◎ | ○ | ○ |
| J5-09 | 38.7 | ○ | 15 | 2 | 15 | ○ | ◎ | ◎ | ○ | ◎ |
| J5-10 | 28.6 | ○ | 15 | 1.5 | 20 | ○ | ◎ | ◎ | ○ | ◎ |
| J5-11 | 30.2 | ○ | 10 | 2 | 20 | ◎ | ◎ | ◎ | ○ | ◎ |
| J5-12 | 32.1 | ○ | 15 | 1.5 | 15 | ◎ | ◎ | ◎ | ◎ | ◎ |
| J5-13 | 35.6 | ○ | 15 | 1 | 10 | ◎ | ◎ | ◎ | ◎ | ◎ |
| J5-14 | 38 | ○ | 15 | 1 | 5 | ◎ | ◎ | ◎ | ◎ | ◎ |
| J5-15 | 38.2 | ○ | 10 | 1.5 | 5 | ◎ | ◎ | ◎ | ◎ | ◎ |
| J5-16 | 38.9 | ○ | 15 | 1 | 10 | ◎ | ◎ | ◎ | ◎ | ◎ |
| J5-17 | 42.6 | ● | 10 | 1 | 15 | ◎ | ○ | ◎ | ◎ | ◎ |
| J5-18 | 45.8 | ● | 15 | 2 | 5 | ◎ | ○ | ◎ | ◎ | ◎ |

TABLE 10-continued

| Embodiment 5 Test No. | L/L (30 k) endurance characteristic streak | flaw | fusion bond | CLN faulty | CLN wear | H/H (30 k) endurance characteristic streak | flaw | fusion bond | CLN faulty | CLN wear |
|---|---|---|---|---|---|---|---|---|---|---|
| J5-01 | ◎ | ◎ | ◎ | ◎ | ◎ | ◎ | ◎ | ◎ | ◎ | ○ |
| J5-02 | ◎ | ◎ | ◎ | ◎ | ◎ | ◎ | ◎ | ◎ | ◎ | ○ |
| J5-03 | ◎ | ◎ | ◎ | ◎ | ◎ | ◎ | ◎ | ◎ | ◎ | ○ |
| J5-04 | ◎ | ◎ | ◎ | ◎ | ◎ | ◎ | ◎ | ◎ | ◎ | ○ |
| J5-05 | ◎ | ◎ | ◎ | ◎ | ◎ | ◎ | ◎ | ◎ | ◎ | ○ |
| J5-06 | ◎ | ◎ | ◎ | ◎ | ◎ | ◎ | ◎ | ◎ | ◎ | ○ |
| J5-07 | ◎ | ◎ | ◎ | ◎ | ◎ | ◎ | ◎ | ◎ | ◎ | ○ |
| J5-08 | ● | ○ | ◎ | ○ | ● | ● | ● | ◎ | ● | ● |
| J5-09 | ● | ◎ | ◎ | ○ | ◎ | ● | ◎ | ◎ | ● | ◎ |
| J5-10 | ○ | ◎ | ◎ | ○ | ◎ | ● | ◎ | ◎ | ● | ◎ |
| J5-11 | ◎ | ◎ | ◎ | ○ | ◎ | ◎ | ◎ | ◎ | ● | ◎ |
| J5-12 | ◎ | ◎ | ◎ | ◎ | ◎ | ◎ | ◎ | ◎ | ◎ | ◎ |
| J5-13 | ◎ | ◎ | ◎ | ◎ | ◎ | ◎ | ◎ | ◎ | ◎ | ◎ |
| J5-14 | ◎ | ◎ | ◎ | ◎ | ◎ | ◎ | ◎ | ◎ | ◎ | ◎ |
| J5-15 | ◎ | ◎ | ◎ | ◎ | ◎ | ◎ | ◎ | ◎ | ◎ | ◎ |
| J5-16 | ◎ | ◎ | ◎ | ◎ | ◎ | ◎ | ◎ | ◎ | ◎ | ◎ |
| J5-17 | ◎ | ● | ◎ | ◎ | ◎ | ◎ | ● | ◎ | ◎ | ◎ |
| J5-18 | ○ | ● | ◎ | ◎ | ◎ | ○ | ● | ◎ | ◎ | ◎ |

From Table 9 and Table 10, it will be seen that a good result was obtained within the range of $1E-1 \leqq B \times Td/S^2 \leqq 1E2$ ($B = \Delta S \times Df^2$), and preferably within the range of $0.111 \leqq B \times Td/S^2 \leqq 8.736$.

If $B \times Td/S^2$ was greater than 1E2, the wear of the photosensitive member due to excessive rubbing occurred, while on the other hand, if $B \times Td/S^2$ was smaller than 1B1, an image defect such as the occurrence of streaks due to deficient rub sometimes occurred.

Even within this range, an image defect due to the wear of the photosensitive member or the unevenness or the like of the rubbing sometimes occurred when as described in the second embodiment, the driving speed of the fur brush was within 100±5% or within 0±5% in terms of relative speed.

[Sixth Embodiment]

By the use of the photosensitive member K0 and the elastic member DR1 or the fur brush F1, the process speed of IR6000 remodeled machine was allotted, that is, the surface speed of the photosensitive member was allotted, and evaluation similar to that in the fourth embodiment and the fifth embodiment was carried out.

By the use of the photosensitive member K0 and IR6000 remodelled machine and by the use of the above-described heater, the temperature Td of the photosensitive member K0 was controlled to 30 to 55° C., and as in the second embodiment, a wear resistance test and evaluation were carried out at N/N, N/L and H/H.

The evaluating conditions by the elastic member are shown in Table 11 below.

TABLE 11

| Embodiment 6 Test No. | speed S [mm/sec] | abutting pressure PS [gf/cm] | driving speed [%] | driving speed difference ΔS [mm/sec] | Td [° C.] | Td [K] | A × Td/S² |
|---|---|---|---|---|---|---|---|
| J6-01 | 30 | 5 | −50% | 45 | 40 | 313.15 | 7.829E+01 |
| J6-02 | 80 | 10 | −25% | 100 | 40 | 313.15 | 4.893E+01 |
| J6-03 | 100 | 20 | −25% | 125 | 40 | 313.15 | 7.829E+01 |
| J6-04 | 120 | 20 | −25% | 150 | 40 | 313.15 | 6.524E+01 |
| J6-05 | 150 | 10 | −25% | 187.5 | 40 | 313.15 | 2.610E+01 |
| J6-06 | 210 | 20 | −25% | 262.5 | 40 | 313.15 | 3.728E+01 |
| J6-07 | 265 | 20 | −25% | 331.3 | 40 | 313.15 | 2.955E+01 |
| J6-08 | 310 | 30 | −25% | 387.5 | 40 | 313.15 | 3.788E+01 |
| J6-09 | 350 | 30 | −25% | 437.5 | 40 | 313.15 | 3.355E+01 |
| J6-10 | 370 | 10 | −25% | 462.5 | 40 | 313.15 | 1.058E+01 |
| J6-11 | 450 | 20 | −100% | 900 | 40 | 313.15 | 2.784E+01 |
| J6-12 | 500 | 20 | −150% | 1250 | 40 | 313.15 | 3.132E+01 |

Also, the result of the evaluation is shown in Table 12 below.

TABLE 12

| Embodiment | | abrasion of photosensitive member | | N/N (40 k) electrical characteristic | | | N/N (40 k) endurance characteristic | | | | |
|---|---|---|---|---|---|---|---|---|---|---|---|
| 6 Test No. | Speed S [mm/sec] | abrasion rate [$10^{-6}$ μm/rot] | evaluation of abrasion | ΔVd [V] | sensitivity ratio [%] | ΔVs1 [V] | streak | flaw | fusion bond | CLN faulty | CLN wear |
| J6-01 | 30 | 23.9 | ○ | 10 | 1.5 | 5 | ○ | ◎ | ○ | ◎ | ◎ |
| J6-02 | 80 | 30.2 | ○ | 10 | 1.5 | 5 | ○ | ◎ | ○ | ◎ | ◎ |
| J6-03 | 100 | 28.8 | ○ | 10 | 1.5 | 5 | ○ | ◎ | ◎ | ◎ | ◎ |
| J6-04 | 120 | 26.5 | ○ | 10 | 1.5 | 5 | ○ | ◎ | ◎ | ◎ | ◎ |
| J6-05 | 150 | 25.9 | ○ | 10 | 1.5 | 5 | ○ | ◎ | ○ | ◎ | ◎ |
| J6-06 | 210 | 25.6 | ○ | 10 | 1.5 | 5 | ○ | ◎ | ○ | ◎ | ◎ |
| J6-07 | 265 | 25.8 | ○ | 10 | 1.5 | 5 | ○ | ◎ | ○ | ◎ | ◎ |
| J6-08 | 310 | 30.6 | ○ | 10 | 1.5 | 5 | ○ | ◎ | ○ | ◎ | ◎ |
| J6-09 | 350 | 39.5 | ○ | 10 | 1.5 | 5 | ○ | ◎ | ○ | ◎ | ◎ |
| J6-10 | 370 | 45.2 | ● | 10 | 1.5 | 5 | ○ | ○ | ◎ | ○ | ◎ |
| J6-11 | 450 | 48.2 | ● | 10 | 1.5 | 5 | ● | ○ | ◎ | ○ | ○ |
| J6-12 | 500 | 49.5 | ● | 10 | 1.5 | 5 | ● | ○ | ◎ | ○ | ○ |

| Embodiment | L/L (30 k) endurance characteristic | | | | | H/H (30 k) endurance characteristic | | | | |
|---|---|---|---|---|---|---|---|---|---|---|
| 6 Test No. | streak | flaw | fusion bond | CLN faulty | CLN wear | streak | flaw | fusion bond | CLN faulty | CLN wear |
| J6-01 | ○ | ◎ | ○ | ◎ | ○ | ○ | ◎ | ○ | ◎ | ○ |
| J6-02 | ○ | ◎ | ○ | ◎ | ○ | ○ | ◎ | ○ | ◎ | ○ |
| J6-03 | ○ | ◎ | ◎ | ◎ | ○ | ○ | ◎ | ○ | ◎ | ○ |
| J6-04 | ○ | ◎ | ◎ | ◎ | ○ | ○ | ◎ | ○ | ◎ | ○ |
| J6-05 | ○ | ◎ | ○ | ◎ | ○ | ○ | ◎ | ○ | ◎ | ○ |
| J6-06 | ○ | ◎ | ○ | ◎ | ○ | ○ | ◎ | ○ | ◎ | ○ |
| J6-07 | ○ | ◎ | ○ | ◎ | ○ | ○ | ◎ | ○ | ◎ | ○ |
| J6-08 | ○ | ◎ | ○ | ◎ | ○ | ○ | ◎ | ○ | ◎ | ○ |
| J6-09 | ○ | ◎ | ○ | ◎ | ○ | ○ | ◎ | ○ | ◎ | ○ |
| J6-10 | ● | ○ | ○ | ○ | ○ | ● | ○ | ○ | ○ | ● |
| J6-11 | ● | ○ | ○ | ○ | ● | ● | ○ | ○ | ● | ● |
| J6-12 | ● | ○ | ○ | ● | ● | ● | ● | ○ | ● | ● |

The evaluating conditions when the fur brush is used are shown in Table 13 below.

TABLE 13

| Embodiment 6 | Speed S | driving speed | ΔS | Td | | |
|---|---|---|---|---|---|---|
| Test No. | [mm/sec] | [%] | [mm/sec] | [° C.] | [K] | B × Td/$S^2$ |
| J6-13 | 30 | 150% | 15 | 40 | 313.15 | 2.572E+01 |
| J6-14 | 80 | 90% | 8 | 40 | 313.15 | 1.929E+00 |
| J6-15 | 100 | 50% | 50 | 40 | 313.15 | 7.717E+00 |
| J6-16 | 150 | 10% | 135 | 40 | 313.15 | 9.260E+00 |
| J6-17 | 210 | −10% | 231 | 40 | 313.15 | 8.084E+00 |
| J6-18 | 265 | −30% | 344.5 | 40 | 313.15 | 7.571E+00 |
| J6-19 | 310 | −50% | 465 | 40 | 313.15 | 7.468E+00 |
| J6-20 | 350 | −150% | 875 | 40 | 313.15 | 1.102E+01 |
| J6-21 | 370 | −100% | 740 | 40 | 313.15 | 8.342E+00 |
| J6-22 | 450 | −25% | 562.5 | 40 | 313.15 | 4.287E+00 |

Also, the result of the evaluation is shown in Table 14.

TABLE 14

| Embodiment | | abrasion of photosensitive member | | N/N (40 k) electrical characteristic | | | N/N (40 k) endurance characteristic | | | | |
|---|---|---|---|---|---|---|---|---|---|---|---|
| 6 Test No. | Speed S [mm/sec] | abrasion rate [$10^{-6}$ μm/rot] | evaluation of abrasion | ΔVd [V] | sensitivity ratio [%] | ΔVs1 [V] | streak | flaw | fusion bond | CLN faulty | CLN wear |
| J6-13 | 30 | 20.3 | ○ | 5 | 1.0 | 5 | ◎ | ◎ | ◎ | ◎ | ◎ |
| J6-14 | 80 | 25.8 | ○ | 5 | 0.5 | 5 | ○ | ◎ | ○ | ◎ | ◎ |
| J6-15 | 100 | 29.5 | ○ | 10 | 1.5 | 10 | ○ | ◎ | ◎ | ◎ | ◎ |
| J6-16 | 150 | 32.6 | ○ | 15 | 1.5 | 15 | ◎ | ◎ | ◎ | ◎ | ◎ |
| J6-17 | 210 | 35.8 | ○ | 10 | 1.0 | 10 | ◎ | ◎ | ◎ | ◎ | ◎ |
| J6-18 | 265 | 38.7 | ○ | 51 | 2.0 | 5 | ◎ | ◎ | ◎ | ◎ | ◎ |
| J6-19 | 310 | 38.9 | ○ | 20 | 1.5 | 5 | ◎ | ○ | ○ | ○ | ○ |
| J6-20 | 350 | 39.5 | ○ | 10 | 1.0 | 10 | ○ | ○ | ○ | ○ | ○ |
| J6-21 | 370 | 40.1 | ○ | 10 | 1.0 | 10 | ○ | ○ | ◎ | ○ | ○ |
| J6-22 | 450 | 42.5 | ○ | 15 | 2.0 | 15 | ● | ● | ◎ | ○ | ◎ |

| Embodiment | L/L (30 k) endurance characteristic | | | | | H/H (30 k) endurance characteristic | | | | |
|---|---|---|---|---|---|---|---|---|---|---|
| 6 Test No. | streak | flaw | fusion bond | CLN faulty | CLN wear | streak | flaw | fusion bond | CLN faulty | CLN wear |
| J6-13 | ◎ | ◎ | ◎ | ◎ | ◎ | ◎ | ◎ | ◎ | ◎ | ◎ |
| J6-14 | ○ | ◎ | ○ | ◎ | ◎ | ○ | ◎ | ○ | ◎ | ◎ |
| J6-15 | ○ | ◎ | ◎ | ◎ | ◎ | ○ | ◎ | ○ | ◎ | ◎ |
| J6-16 | ◎ | ◎ | ◎ | ◎ | ◎ | ◎ | ◎ | ◎ | ◎ | ○ |
| J6-17 | ◎ | ◎ | ◎ | ◎ | ◎ | ◎ | ◎ | ◎ | ◎ | ○ |
| J6-18 | ◎ | ◎ | ◎ | ◎ | ◎ | ◎ | ◎ | ◎ | ◎ | ○ |
| J6-19 | ◎ | ○ | ○ | ○ | ○ | ◎ | ○ | ○ | ○ | ○ |
| J6-20 | ○ | ○ | ○ | ○ | ○ | ○ | ○ | ○ | ○ | ○ |
| J6-21 | ● | ○ | ◎ | ○ | ● | ● | ● | ◎ | ● | ● |
| J6-22 | ● | ● | ◎ | ○ | ◎ | ● | ● | ◎ | ● | ◎ |

From Table 11 to Table 14, it will be seen that a good result was obtained when the surface speed of the photosensitive member was within a range of 350 mm/sec. or less. If 350 mm/sec. is exceeded, the wear of the photosensitive member may sometimes occur.

Also, in a low-speed machine of less than 100 mm/sec. (substantially 20 ppm), the life level required in the market is thousand of sheets to tens of thousands of sheets. A photosensitive member having a hardened type surface layer like that of the present invention and further, a rubbing member can technically obtain a good result, but suffer from an increase in cost and therefore are not always practical from the viewpoint of exposure vs. effect.

[Seventh Embodiment]

In contrast with a construction in which by the use of the elastic members DR1–DR13 and the fur brushes F1–F12 which are the rubbing members of the fourth embodiment to the fifth embodiment, a good result was obtained in the fourth embodiment to the fifth embodiment, the elastic member is disposed so that the longitudinal direction thereof may be inclined by 2° with respect to the longitudinal direction of the photosensitive member, and the fur brush is disposed with the longitudinal direction thereof inclined by 5° with respect to the longitudinal direction of the photosensitive member.

Evaluation similar to that in the fourth embodiment to the fifth embodiment was carried out with a result that there was obtained a result better than that in the fourth embodiment to the fifth embodiment. Also, even under a condition in which the driving speed difference ΔS is smaller than in the fourth embodiment to the fifth embodiment, particularly the streak level assumed the ◎ level, and the set latitude widened.

[Eighth Embodiment]

Evaluation similar to that in the first embodiment to the seventh embodiment carried out by the IR6000 remodeled machine was carried out by the use of CP680 remodeled machine and CLC5000 remodeled machine.

As a result, when as by the IR6000 remodelled machine, the rubbing step was driven at a relative speed of −150 through +150% (excluding the range of 0±5% and the range of +100±5%) to the photosensitive member, a good result was obtained.

Also, as regards the elastic member, the range of 5–30° in terms of Asker-C hardness and the range of $1E0 \leqq A \times Td/S^2 \leqq 5E2$ ($A=\Delta S \times Ps$) were good.

As regards the fur brush, the range of 0.56-3.33 tex and the range of $1E-1 \leqq B \times Td/S^2 \leqq 1E2$ ($B=\Delta S \times Df^2$) were good.

As the surface temperature Td of the photosensitive member, the range of 35° C. or higher and 50° C. or less was a preferable range, and as the surface speed of the photosensitive member, the range of 350 mm/sec. or less was a preferable range.

Summing up, the present invention used a photosensitive member of which HU is 150 N/mm$^2$ or greater and 220 N/mm$^2$ or less and We is 40% or greater and 65% or less, and on the basis of chiefly having the rubbing step and the step of controlling the surface temperature Td of the photosensitive member, the condition of the rubbing step and the controlled temperature condition were given.

Thereby, an image deletion and a streak-like defect can be deterred and besides, faulty cleaning such as the turn-up of the cleaning blade, slipping-away, fusion bond and filming can be suppressed to thereby secure a stable quality of image and a stable cleaning property for a long period of time.

Also, by using the rubbing step together with the temperature controlling step, the rubbing of the photosensitive member can be rendered into a lower level of rubbing, and the wear of not only the photosensitive member but also the cleaning member is prevented to thereby achieve a longer life thereof, and a similar effect was also obtained about the maintenance-free characteristic.

Further, the amount of untransferred developer, i.e., the amount of so-called waste toner, was decreased. It is considered that the photosensitive member was suitably subjected to rubbing and temperature control and maintained a good surface property, whereby the transfer efficiency through endurance was improved.

As described above, according to the present invention, there can be provided an image forming method and an image forming apparatus which can output good images for a long period of time.

Also, a good cleaning property can be kept for a long period of time, and no faulty image occurs and the durability of the photosensitive member and the cleaning member can be improved.

Also, it becomes possible to prevent an image defect such as a streak-like defect due to rub and on the other hand, maintain the durability of the photosensitive member and the cleaning means at a high level.

This application claims priority from Japanese Patent Application No. 2003-398684 filed on Nov. 28, 2003, which is hereby incorporated by reference herein.

What is claimed is:

1. An image forming apparatus comprising:

a photosensitive member;

charging means for charging said photosensitive member;

developing means for developing an electrostatic image formed on said photosensitive member by a developer;

cleaning means for removing the developer residual on said photosensitive member;

rubbing means provided upstream of said cleaning means in a direction of rotation of said photosensitive member for rubbing said photosensitive member to assist said cleaning means in cleaning; and controlling means for controlling a surface temperature of said photosensitive member, wherein said photosensitive member has HU (universal hardness value) of 150 $N/mm^2$ or greater and 220 $N/mm^2$ or less, and an elastic deformation rate of 43% or greater and 65% or less, wherein said rubbing means is provided with a rubbing member driven at a peripheral speed of −150% through +150% relative to a peripheral speed of said photosensitive member, and wherein when the peripheral speed of said photosensitive member is defined as S mm/sec., and a peripheral speed difference between the peripheral speed of said rubbing member and the peripheral speed of said photosensitive member is defined as ΔS mm/sec., and the surface temperature of said photosensitive member is defined as Td K, and an abutting pressure of said rubbing member against said photosensitive member per unit length of said photosensitive member in a longitudinal direction thereof is defined as Ps gf/cm, $$1E0 \leqq \Delta S \times Ps \times Td/S^2 \leqq 5E2$$

is satisfied.

2. An image forming apparatus comprising:

a photosensitive member:

charging means for charging said photosensitive member;

developing means for developing an electrostatic image formed on said photosensitive member by a developer;

cleaning means for removing the developer residual on said photosensitive member;

rubbing means provided upstream of said cleaning means in a direction of rotation of said photosensitive member for rubbing said photosensitive member to assist said cleaning means in cleaning; and controlling means for controlling a surface temperature of said photosensitive member, wherein said photosensitive member has HU (universal hardness value) of 150 $N/mm^2$ or greater and 220 $N/mm^2$ or less, and an elastic deformation rate of 43% or greater and 65% or less, and wherein said rubbing means is provided with a rubbing member driven at a peripheral speed of −150% through +150% relative to a peripheral speed of said photosensitive member, and wherein said rubbing member is a fur brush of 0.56–3.33 tex (5D–30D), and wherein when the peripheral speed of said photosensitive member is defined as S mm/sec., and a peripheral speed difference between the peripheral speed of said rubbing member and the peripheral speed of said photosensitive member is defined as ΔS mm/sec., and a thickness of a fiber of said fur brush is defined as Df tex, and the surface temperature of said photosensitive member is defined as Td (K), $$1E{-1} \leqq \Delta S \times Df^2 \times Td/S^2 \leqq 1E2$$

is satisfied.

3. An image forming apparatus according to claim 1 or 2, wherein the peripheral speed S mm/sec. of said photosensitive member is 100–350 mm/sec.

4. An image forming apparatus comprising:

a photosensitive member;

charging means for charging said photosensitive member;

developing means for developing an electrostatic image formed on said photosensitive member by a developer;

cleaning means for removing the developer residual on said photosensitive member;

rubbing means provided upstream of said cleaning means in a direction of rotation of said photosensitive member for rubbing said photosensitive member to assist said cleaning means in cleaning; and controlling means for controlling a surface temperature of said photosensitive member, wherein said photosensitive member has HU (universal hardness value) of 150 $N/mm^2$ or greater and 220 $N/mm^2$ or less, and an elastic deformation rate of 43% or greater and 65% or less, and wherein said rubbing means is provided with a rubbing member driven at a peripheral speed of −150% through +150% relative to a peripheral speed of said photosensitive member, and wherein the longitudinal direction of said rubbing member is inclined with respect to a longitudinal direction of said photosensitive member.

* * * * *

UNITED STATES PATENT AND TRADEMARK OFFICE

CERTIFICATE OF CORRECTION

PATENT NO. : 7,177,581 B2
APPLICATION NO. : 10/995301
DATED : February 13, 2007
INVENTOR(S) : Masaya Kawada et al.

It is certified that error appears in the above-identified patent and that said Letters Patent is hereby corrected as shown below:

COLUMN 6:
Line 19, “present-embodiment,” should read --present embodiment,--.

COLUMN 12:
Line 29, “than.” should read --than--.

COLUMN 14:
Line 34, “100°C./min.)” should read --10°C./min.)--.

COLUMN 19:
Line 48, “and—is” should read --and - is--.

COLUMN 21:
Line 35, “A” should read --Δ--.

COLUMN 22:
Line 26, “surface” should read --surfaces--.

COLUMN 28:
Table T3, “3.518E-00” should read --3.518E+00--.

COLUMN 30:
Table 4, “○” should read --◎--.

COLUMN 32:
Line 13, “$S^2$≤=5E2” should read --$S^2$≤5E2--.
Table 5, the data at line J3-01, should appear at line J3-05.

COLUMN 37:
Line 4, “5.233≤AΔTd/$S^2$≤493.6.” should read --5.233≤A×td/$S^2$≤493.6.--.

COLUMN 39:
Line 32, “1B1,” should read --1E-1,--.

COLUMN 43:
Table 14, “51” should read --15--.

UNITED STATES PATENT AND TRADEMARK OFFICE

CERTIFICATE OF CORRECTION

PATENT NO. : 7,177,581 B2
APPLICATION NO. : 10/995301
DATED : February 13, 2007
INVENTOR(S) : Masaya Kawada et al.

It is certified that error appears in the above-identified patent and that said Letters Patent is hereby corrected as shown below:

COLUMN 45:
Line 30, "rub" should read --rubbing--.

Signed and Sealed this

Seventh Day of August, 2007

JON W. DUDAS
*Director of the United States Patent and Trademark Office*